US010597211B2

(12) United States Patent
Corten

(10) Patent No.: US 10,597,211 B2
(45) Date of Patent: Mar. 24, 2020

(54) FLUID HANDLING CONTAINERS, SYSTEMS, AND RELATED METHODS

(71) Applicant: PALL LIFE SCIENCES BELGIUM BVBA, Hoegaarden (BE)

(72) Inventor: Yvan Corten, Diest (BE)

(73) Assignee: PALL LIFE SCIENCES BELGIUM BVBA, Hoegaarden (BE)

( * ) Notice: Subject to any disclaimer, the term of this patent is extended or adjusted under 35 U.S.C. 154(b) by 1141 days.

(21) Appl. No.: 14/401,938

(22) PCT Filed: May 20, 2013

(86) PCT No.: PCT/EP2013/060342
§ 371 (c)(1),
(2) Date: Nov. 18, 2014

(87) PCT Pub. No.: WO2013/171340
PCT Pub. Date: Nov. 21, 2013

(65) Prior Publication Data

US 2015/0151892 A1 Jun. 4, 2015

Related U.S. Application Data

(60) Provisional application No. 61/648,986, filed on May 18, 2012.

(51) Int. Cl.
*B65D 77/06* (2006.01)
*B01F 15/00* (2006.01)
(Continued)

(52) U.S. Cl.
CPC ..... *B65D 77/065* (2013.01); *B01F 13/0818* (2013.01); *B01F 13/0827* (2013.01);
(Continued)

(58) Field of Classification Search
CPC .... B65D 77/065; B65D 77/06; B65D 77/064; B65D 77/062; B65D 25/20
(Continued)

(56) References Cited

U.S. PATENT DOCUMENTS 1,647,581 A 11/1927 Redemski
2,807,402 A 9/1957 Nelbach
(Continued)

FOREIGN PATENT DOCUMENTS

FR 2686321 A1 * 7/1993 ..... B65D 77/065
JP JU05-068872 9/1993
(Continued)

OTHER PUBLICATIONS

Merriam-Webster.com (accessed Oct. 4, 2019).*

*Primary Examiner* — Marc C Howell
(74) *Attorney, Agent, or Firm* — King & Schickli, PLLC

(57) ABSTRACT

An apparatus (10) receives an at least partially flexible vessel (14) adapted for receiving a fluid. The apparatus (10) may include an overpack (12) and a partition (16) removably positioned in an interior of the overpack (12). The partition (16) may extend generally transverse to a sidewall (12*b*) and generally aligned with a floor (12*c*) of the overpack (12) to form a compartment for receiving the vessel (14). The partition (16) may also form part of a carrier (17) for the vessel (14). A filling station for filling containers (10) is also disclosed, as are related methods.

20 Claims, 21 Drawing Sheets

(51) Int. Cl.
*B01F 13/10* (2006.01)
*B01F 13/08* (2006.01)
*B67D 7/08* (2010.01)

(52) U.S. Cl.
CPC ..... *B01F 13/1022* (2013.01); *B01F 15/0085* (2013.01); *B67D 7/08* (2013.01)

(58) Field of Classification Search
USPC ..... 366/273
See application file for complete search history.

(56) References Cited

U.S. PATENT DOCUMENTS

| | | | | |
|---|---|---|---|---|
| 4,623,075 | A * | 11/1986 | Riley | B65D 5/445 222/105 |
| 4,968,624 | A | 11/1990 | Bacehowski et al. | |
| 2003/0183650 | A1* | 10/2003 | Muise | B65D 77/065 222/105 |
| 2005/0002274 | A1* | 1/2005 | Terentiev | B01F 1/0011 366/273 |
| 2005/0173439 | A1* | 8/2005 | Chen | B65D 77/06 220/495.06 |
| 2006/0180643 | A1* | 8/2006 | Stephenson | B65D 5/46008 229/117.3 |
| 2010/0102112 | A1* | 4/2010 | Ouillette | B65D 5/46016 229/117.32 |

FOREIGN PATENT DOCUMENTS

| | | |
|---|---|---|
| JP | JU7-11570 | 2/1995 |
| JP | 2003-072842 | 3/2003 |
| JP | 2003-095249 | 4/2003 |
| WO | 2006096510 A1 | 9/2006 |
| WO | 2007072522 A1 | 6/2007 |

* cited by examiner

FLUID HANDLING CONTAINERS, SYSTEMS, AND RELATED METHODS

This application claims the benefit of U.S. Provisional Patent Application Ser. No. 61/648,986, the disclosure of which is incorporated herein by reference.

TECHNICAL FIELD

This disclosure relates generally to the fluid handling arts and, more particularly, to containers for handling fluids, systems for handling fluids, and related fluid handling methods.

BACKGROUND

Fluid handling applications often employ one or more disposable vessels for at least temporarily receiving and containing the fluid during the processing operation. For example, in the course of bioprocessing, sealed containers of flexible plastic film (referred to as "bags" in the vernacular) are often used under sterile conditions for fluid storage, cell culture re-suspension, viral inactivation, final formulation, final fill, and in other areas, including as bioreactors.

Despite the overwhelming acceptance of such containers in the market as being reliable for fluid handling (and particularly in relation to bioprocessing, given the requirement for sterility in many applications and the desire to avoid cleaning/reuse), limitations remain. For one, dealing with fluid-filled flexible bags can be a challenge, as their thin walls and amorphous shape when filled dictates special handling considerations. Separate rigid containers may be used to provide external support, but these containers are typically designed to accommodate only a single size and shape of vessel (such as, for example, a "bag-in-box" type of arrangement, where an inner bag is specially adapted for occupying the entire volume of an outer box). Filling of the vessels often involves guesswork based on visual acuity, which can at best lead to inconsistency, and is virtually impossible when the container is comprised of opaque materials that make accurate visual perception of the fluid level impossible.

Thus, a need is identified for a manner of providing an improved container for use in fluid handling, and bioprocessing in particular. The container would be capable of use in addressing a variety of different requirements for fluid processing operations, including the proper filling of the container, as well as the ability to manipulate and transport it in an easy and efficient manner. Overall, use of the improved container would thus lead to a simplification of the fluid processing operation with improved results and a concomitant reduction in the expense associated with such use.

SUMMARY

According to one aspect of the disclosure, an apparatus is provided for receiving an at least partially flexible vessel adapted for receiving a fluid. The apparatus may include an overpack including a base having a floor and an upstanding sidewall forming an interior for receiving the vessel. A partition may be removably positioned in the interior of the overpack. The partition may extend generally transverse to the sidewall and generally aligned with the floor to form a compartment in the interior of the overpack for receiving the vessel. In one embodiment, the base of the overpack includes a door for providing access to an exterior compartment of the base. The overpack may also include at least one hanger for hanging the overpack in an inverted condition, and the base may include the hanger. The door may comprise a pair of hinged flaps, each including at least one opening to form the hanger. The hanger may be integrally formed with the overpack, and may comprise a strap loop.

The overpack may further include an upper wall adapted for receiving a conduit for connecting with the vessel in the overpack. The partition may be adapted for receiving the conduit. The partition may further include an apex formed by a pair of sloped walls adapted for causing fluid to drain from the vessel. The partition may include a generally C-shaped cross-section.

The apparatus may further include a coupler adapted for forming a non-contact coupling with a component in the vessel. The component may comprise, for example, a magnetic agitator. The coupler may, for example, comprise a material for forming a magnetic coupling with the magnetic agitator.

The overpack may comprise a rigid material. Particular materials used may include cardboard, paperboard, plastic, and combinations thereof. The particular material may also be corrugated for added strength.

A retainer may also be provided for removably retaining the partition within the interior compartment of the overpack. At least one receiver may also be provided for receiving a lifting device. In one particular embodiment, the overpack includes a pair of spaced receivers, each adapted for receiving one fork of a bifurcated lifting device.

The overpack may comprise an upper wall formed of two or more mating panels adapted to interlock with each other. The overpack may further include a handle. In one embodiment, the handle comprises at least one opening formed in at least one sidewall of the overpack, the opening adapted for being grasped by a hand of a user. The apparatus may further include a tubing positioned in a space between an upper surface of the partition and a lower surface of an upper wall of the overpack.

The overpack may have a particular cross-sectional shape. For example, the overpack may be generally polygonal in cross-section. Another example is a generally square in cross-section.

The apparatus may further include a carrier adapted for receiving the vessel and for nesting in the interior of the overpack. The carrier may include the partition. The apparatus may further include a support for supporting the partition in at least an inverted condition of the overpack, which may optionally form part of the carrier. In one embodiment, the support comprises at least one upstanding wall extending from the partition to a lower wall of the inverted overpack.

A further aspect of the disclosure relates to an apparatus for receiving an at least partially flexible vessel adapted for receiving a fluid. The apparatus comprises an overpack including an interior for receiving the vessel, and a partition for positioning in the interior of the overpack adjacent to the vessel. The partition may include a taper in a vertical direction for assisting in draining fluid from the vessel when positioned in the interior of the overpack.

In one embodiment, the vessel includes a conduit for receiving fluid. The conduit may pass through the partition into a space between a first surface of the partition and an opposing, second surface of the overpack. The partition may be at least partially above or at least partially below the vessel when in the overpack.

The disclosure also presents as a further aspect an apparatus for receiving an at least partially flexible vessel adapted for receiving a fluid. The apparatus comprises an overpack for receiving the vessel. The overpack may include a hanger for hanging the overpack in an inverted condition. In one embodiment, the overpack is more rigid than the flexible vessel.

Another aspect of this disclosure pertains to an apparatus for handling a fluid. The apparatus comprises an overpack including an interior for receiving the vessel. The overpack includes a base connected to at least one upstanding sidewall. A vessel is provided for positioning in the interior of the overpack, and which vessel includes at least one component. A partition may also be provided for positioning in the interior of the overpack adjacent to the vessel. A coupler for forming a non-contact coupling with the component of the vessel is also provided.

The component may comprise a magnetic impeller. In such case, the coupler may be adapted for forming a magnetic coupling with the magnetic impeller prior to being engaged by a magnetic driver for driving the impeller. The vessel may also comprise a flexible bag, and the overpack may be rigid.

Related aspects of the disclosure pertain to a pallet carrying a plurality of the apparatuses as described above. Furthermore, a filling station may be provided for filling the vessel with the fluid when positioned in the interior of the overpack constructed according to the foregoing description. An assembly may include a bag for containing a plurality of the apparatuses of any of the foregoing disclosure.

A further aspect of this disclosure relates to a system for use in filling a plurality of fluid containers with fluid from a fluid source. The system comprises a first delivery line for simultaneously delivering the fluid to the plurality of containers. A valve is associated with each of the containers for controlling the flow of fluid from the delivery line to the container. A measuring device is also provided for measuring the fluid delivered to at least one of the containers and generating a corresponding output. A controller is also provided for controlling the valve based on the output.

The measuring device may comprise a scale. A scale may also be provided for weighing each of the plurality of containers. The measuring device may comprise a flow meter, a metering pump, or the like.

The first delivery line is associated with a branch line for delivering the fluid to each of the plurality of containers. Each valve may be associated with one branch line. A pump may also be provided for pumping fluid through the first delivery line, and at least one reservoir may be provided for receiving fluid remaining in the first delivery line when the valves are closed. A reservoir may also be connected to the first delivery line for receiving gas purged from the containers. A second delivery line may also be used for delivering a fluid in parallel with the first delivery line.

Related methods are also disclosed. For instance, a method for processing a fluid in a bag-in-box container including at least one port formed in an upper portion thereof is described. The method comprises inverting the bag-in-box container to drain fluid from the at least one port. The method may further include providing the bag-in-box with an at least partially sloped wall when inverted for assisting in draining the fluid through the port. The method may further include the step of using an integral mixer in the bag-in-box container to agitate or resuspend the fluid prior to the step of inverting.

A further method for filling a plurality of vessels is also described. The method comprises simultaneously filling the vessels through a common delivery line associated with a valve for controlling the fluid flow to each vessel, and closing the valve associated with each vessel when a pre-determined condition is reached. The method may further include the step of weighing the vessels, and wherein the pre-determined condition comprises a particular weight.

A further aspect of this disclosure relates to a fluid handling apparatus, comprising a box, a carrier for nesting in the box, and a bag adapted for receiving the fluid and for positioning in the carrier. The carrier may include a sloped wall for assisting in guiding the fluid to a drain of the bag. The sloped wall may comprise an upper wall of the carrier adjacent to an upper wall of the box, which upper wall may include an opening for receiving a port of the bag. The upper wall may also include vertically extending supports for engaging an upper wall of the box when inverted.

The bag may further include a mixer, and a retainer may be provided for retaining the mixer. The retainer may comprise a coupler for forming a non-contact coupling with the mixer. The coupler may be positioned in an exterior compartment of the box spaced from an interior compartment for receiving the bag.

Further to the foregoing disclosure is the provision of an apparatus comprising a bag including a magnetic mixer, an overpack for receiving the bag, and a coupler for forming a magnetic coupling with the magnetic mixer through the overpack. Still further, an apparatus comprising a flexible vessel includes a magnetic mixer, an overpack for receiving the flexible vessel, and a coupler for forming a magnetic coupling with the magnetic mixer through the overpack.

A related method for processing a fluid comprises at least partially filling a bag with the fluid, mixing the fluid using a mixer in the bag, and inverting the bag to dispense the fluid. The filling and dispensing steps may be completed using the same port. The filling and dispensing steps may be completed using different ports on the same port fitment, as well as by using ports connected to a common wall of the bag. The method may further include the step of retaining the mixer to prevent movement relative to the bag prior to the inverting step. The filling step may comprise filling the bag in an overpack, and the inverting step may comprise inverting the bag and the overpack together.

BRIEF DESCRIPTION OF THE DRAWING FIGURES

Figure 6:
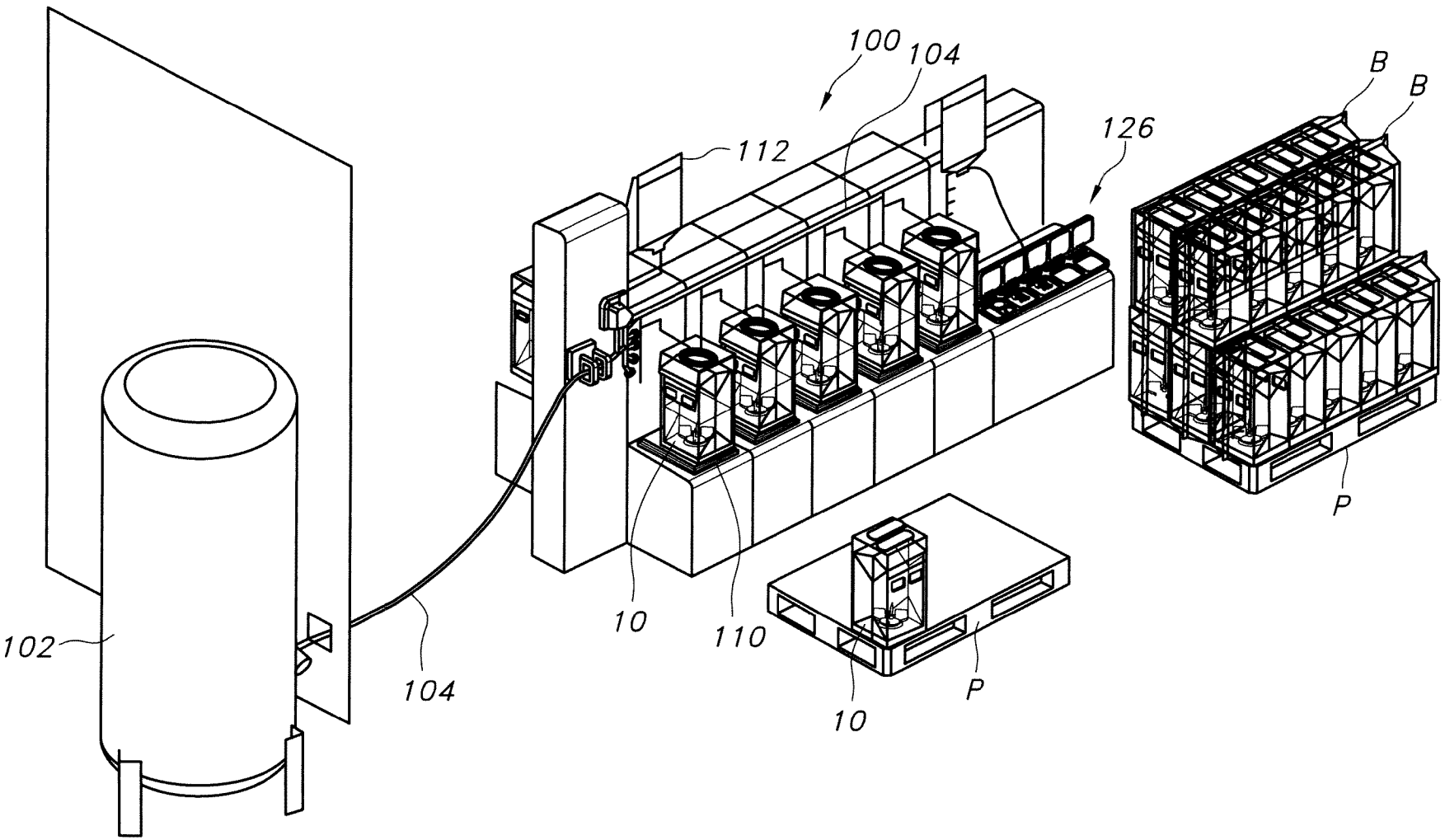
Figure 7:
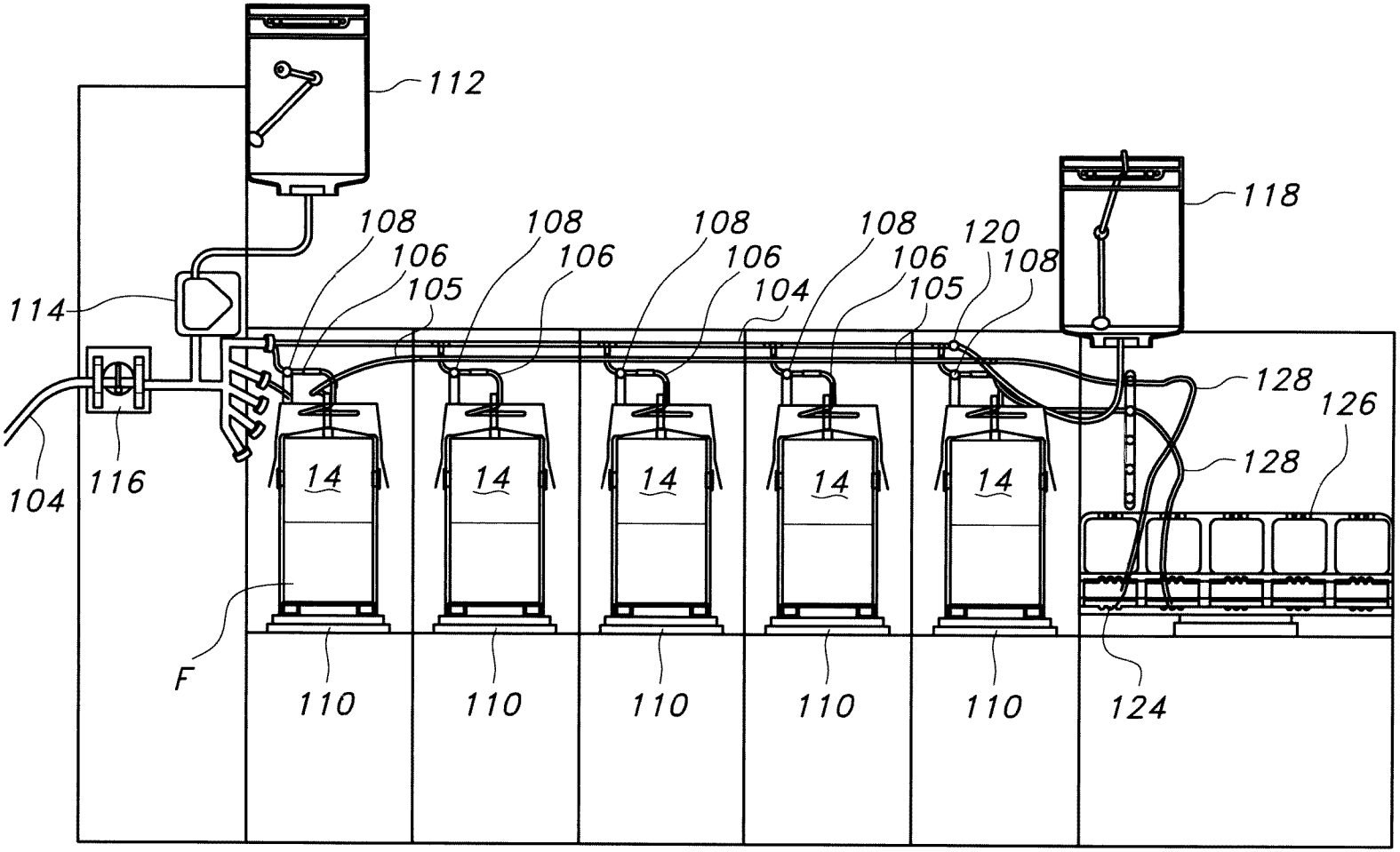
Figure 7A:
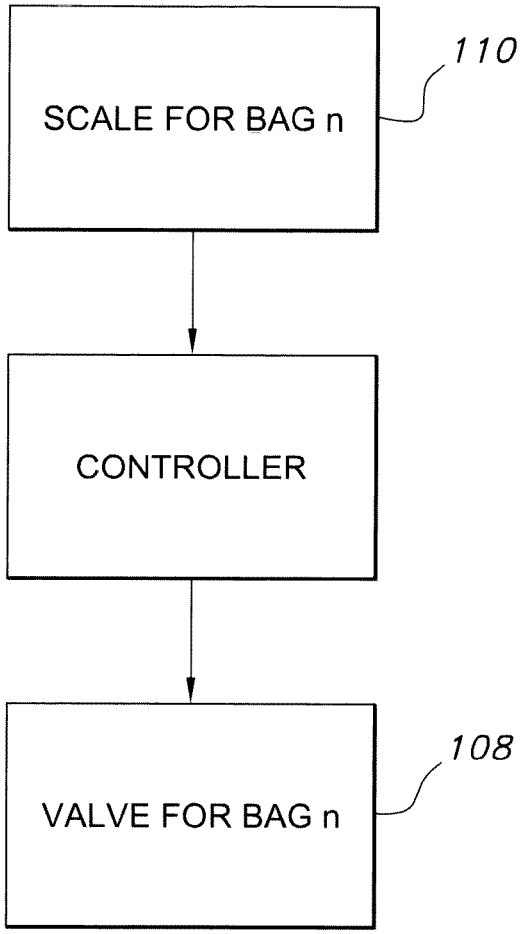
Figure 8:
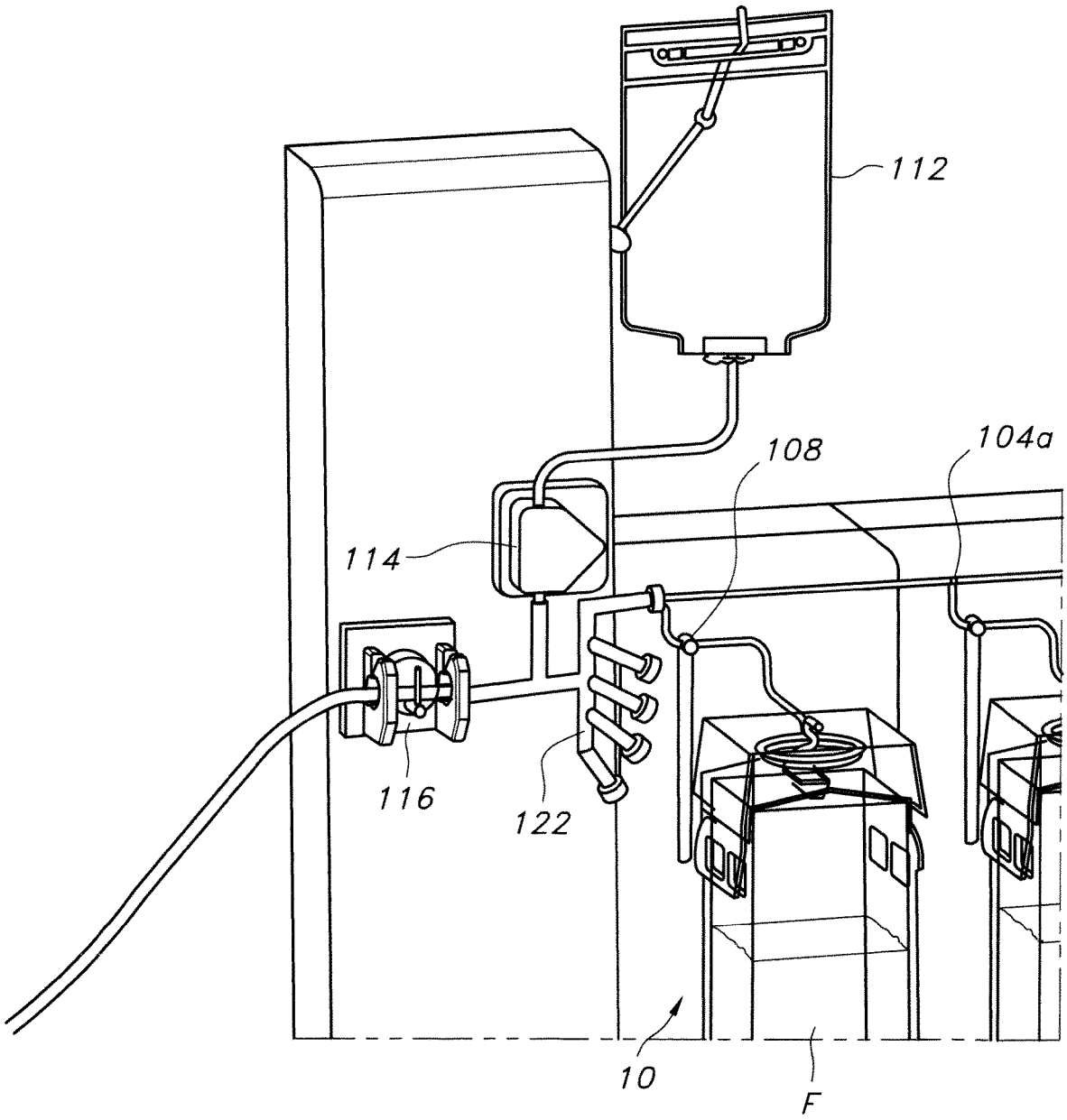
Figure 9:
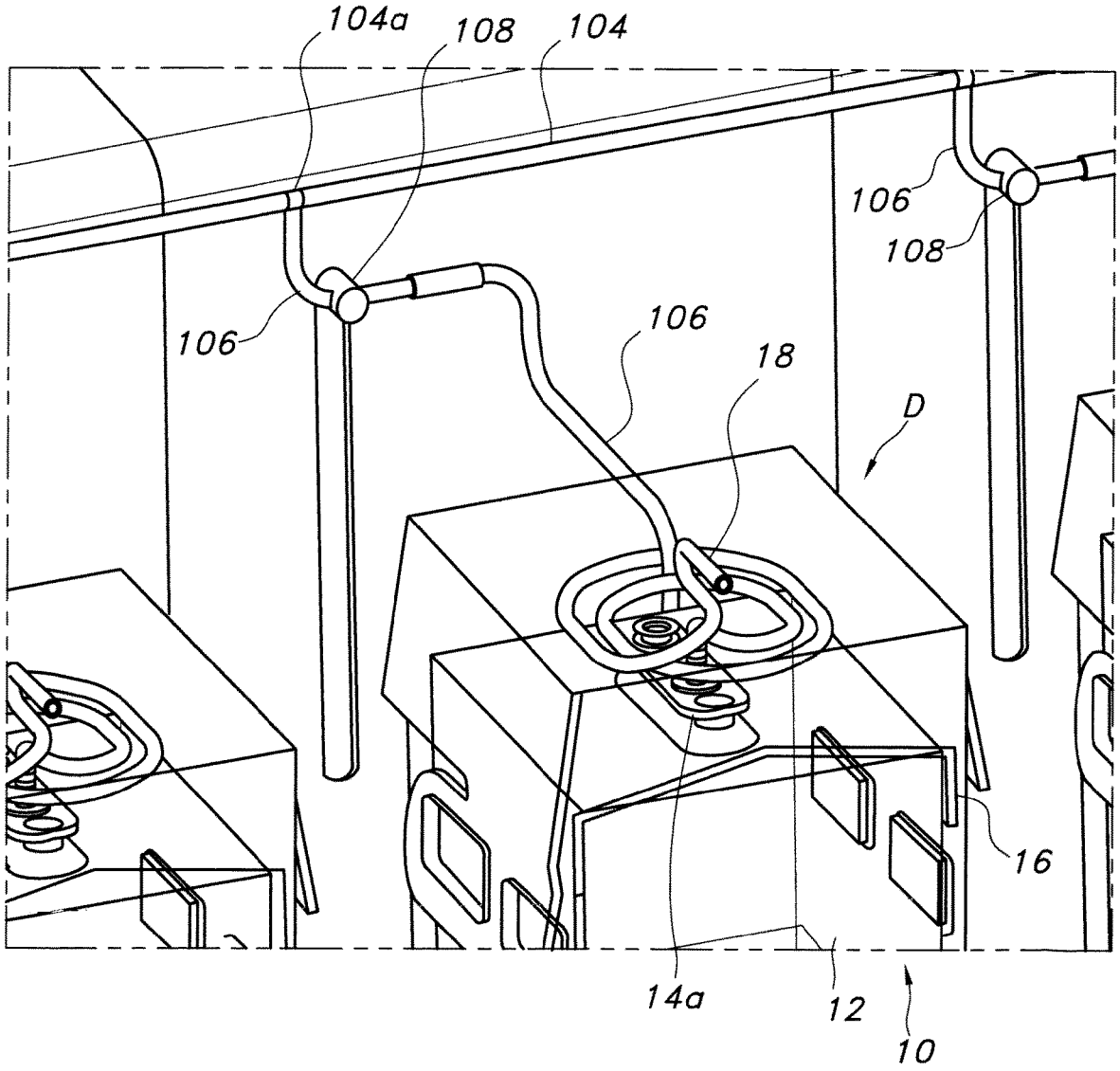
Figure 10:
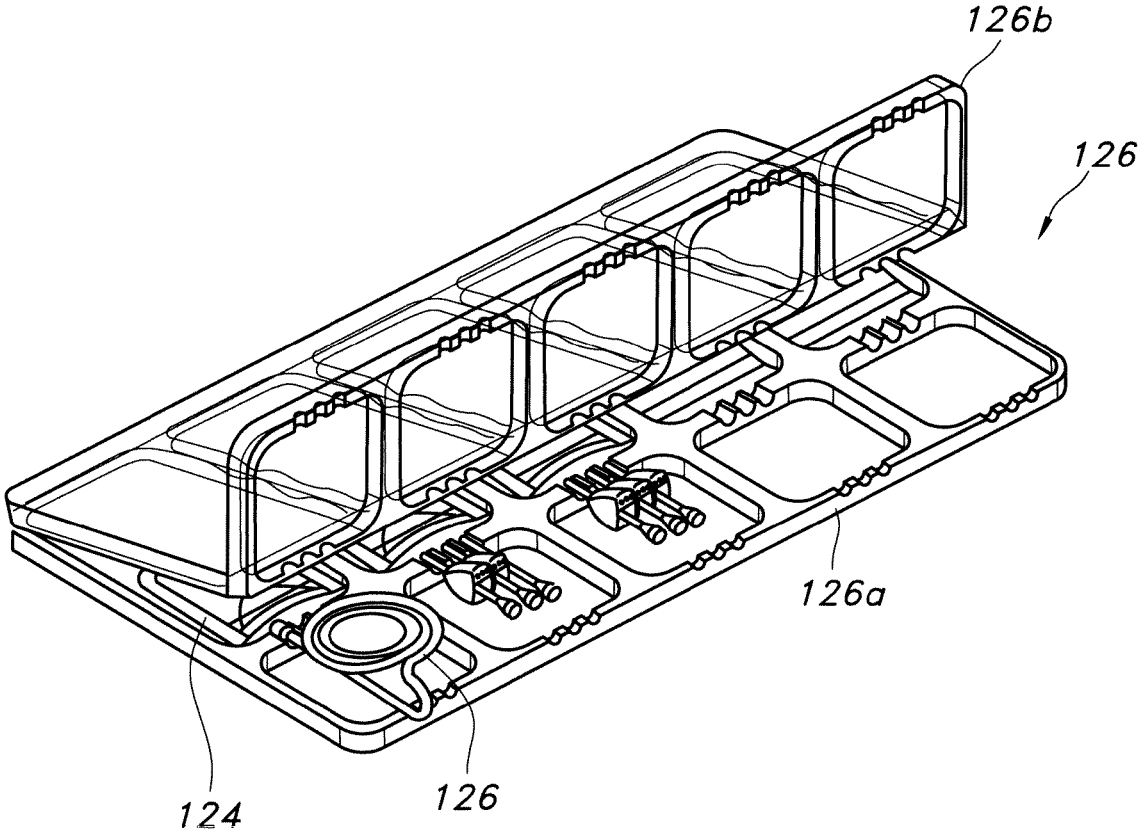
Figure 11:
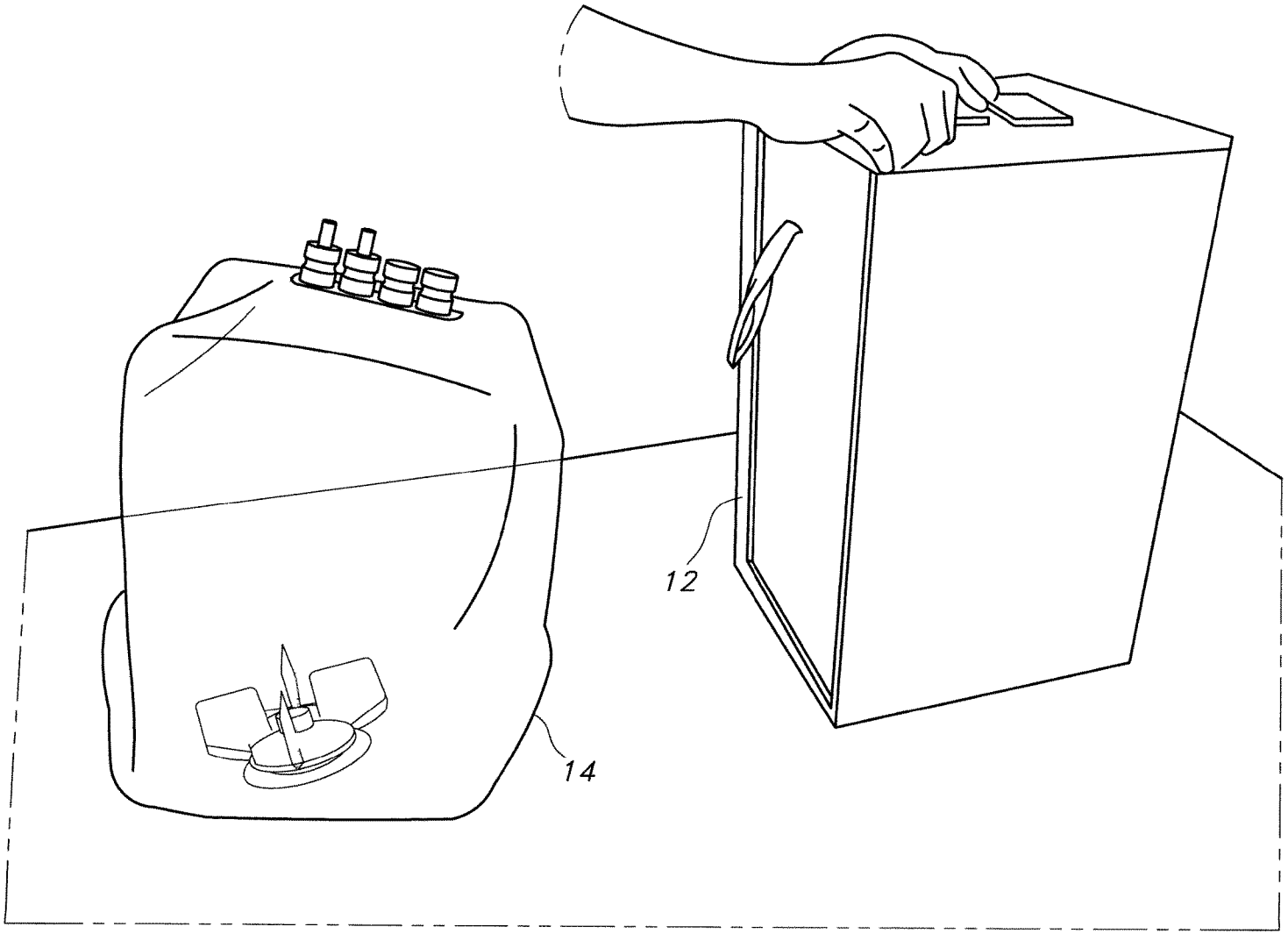
Figure 12:
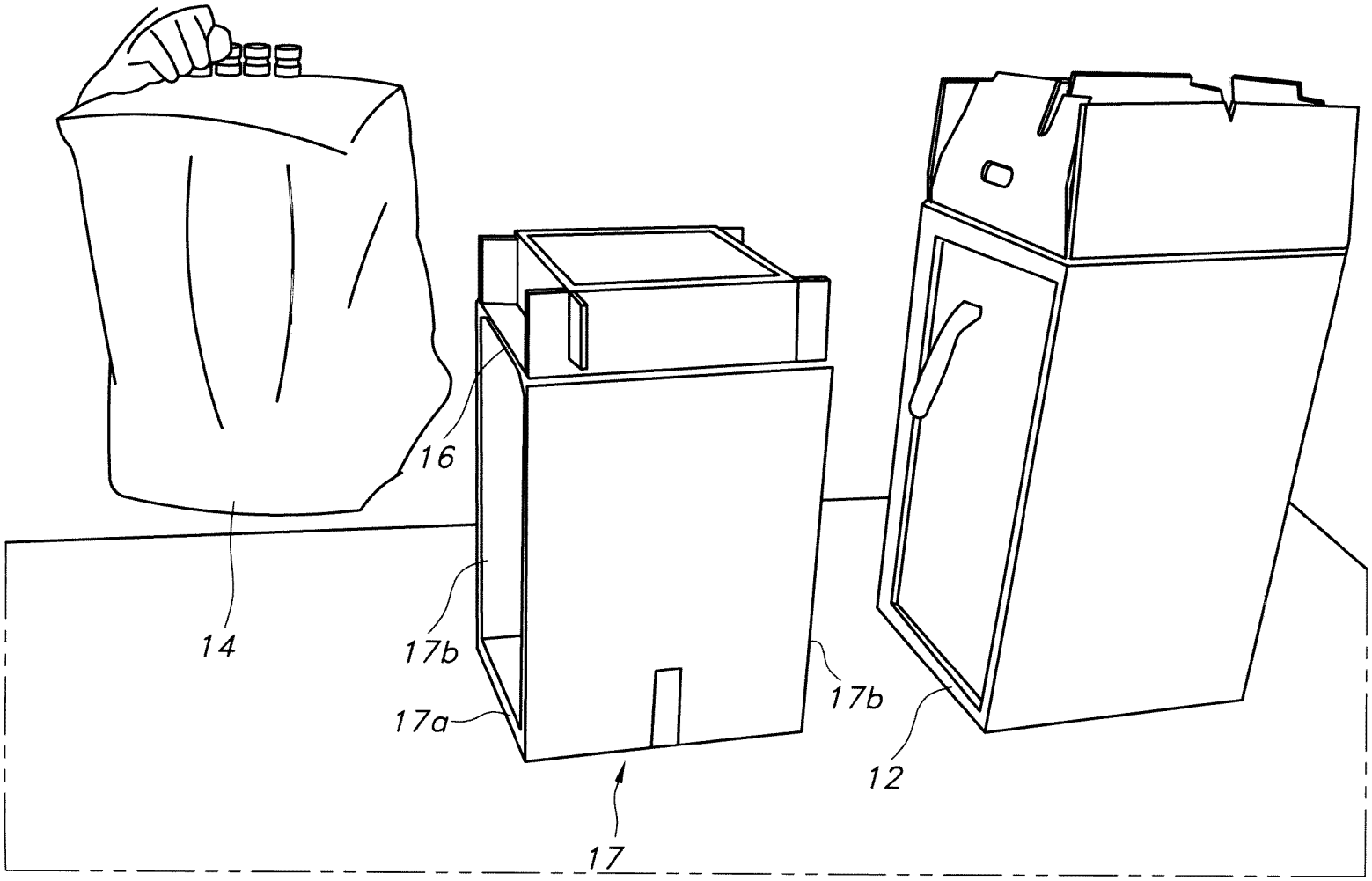
Figure 17:
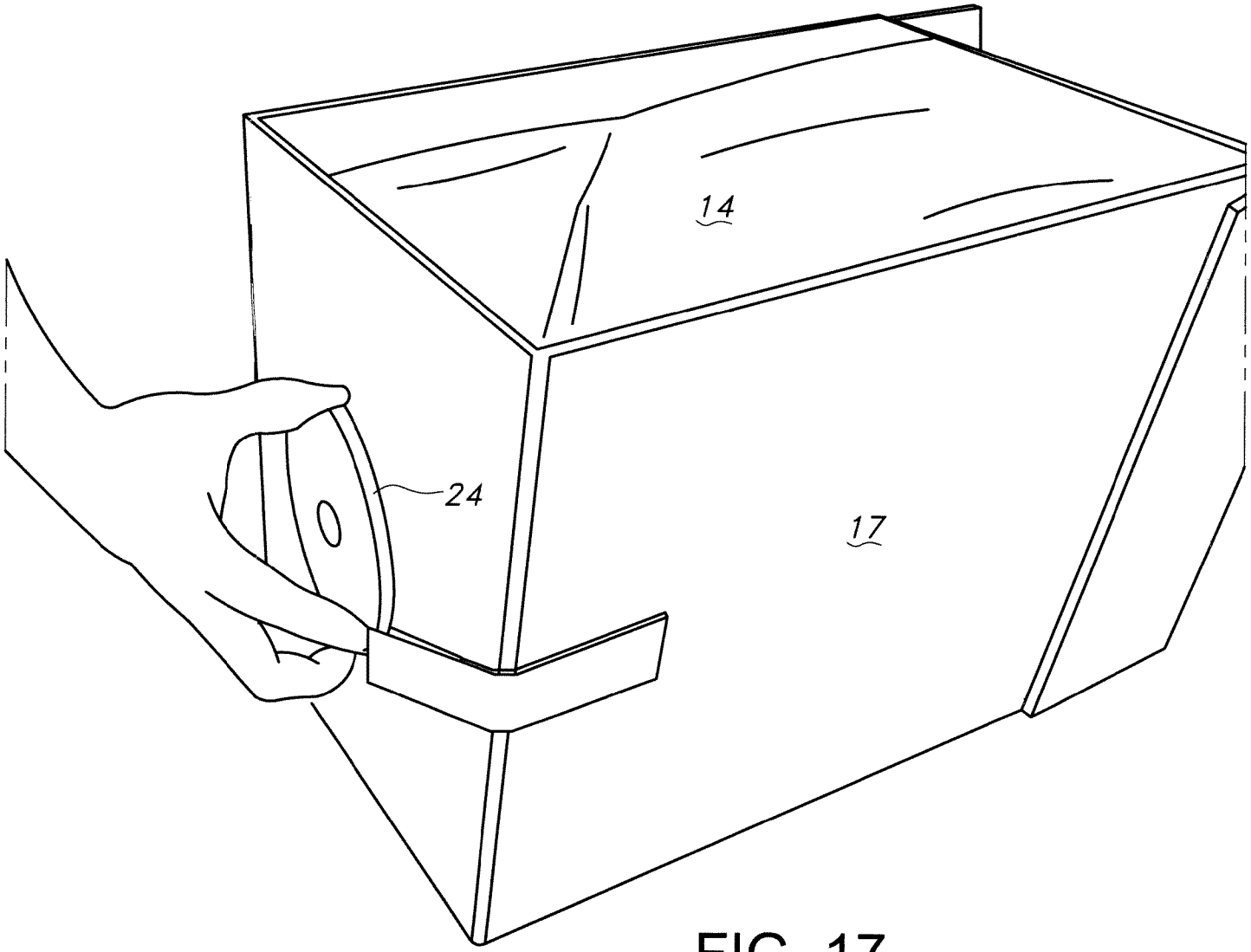
Figure 18:
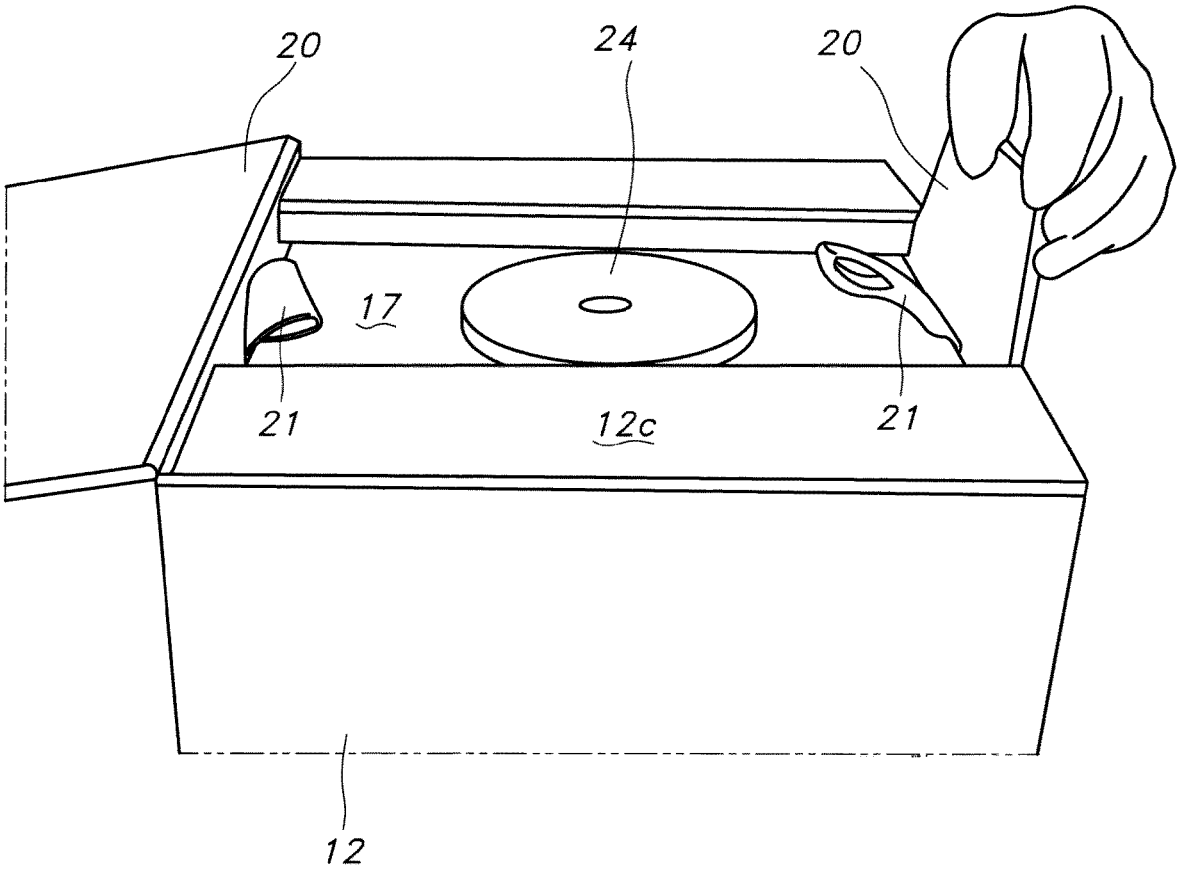
Figure 19:
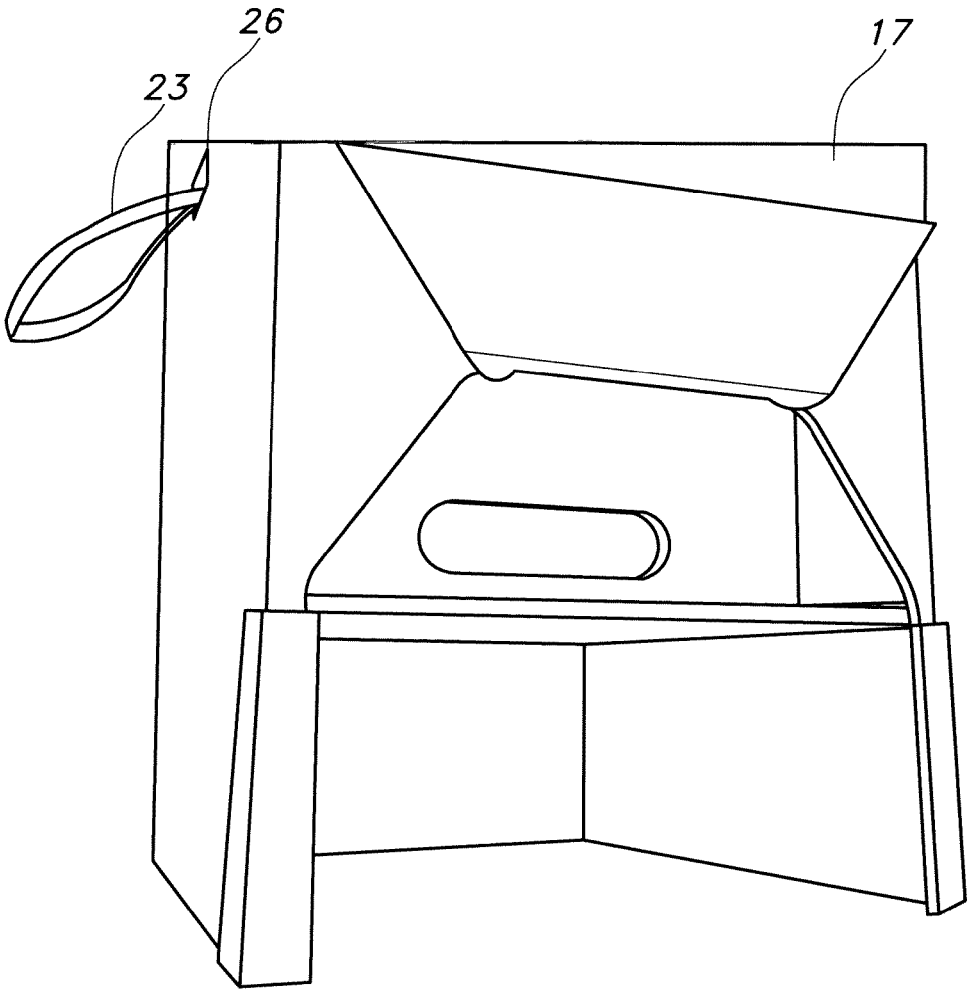
Figure 20:
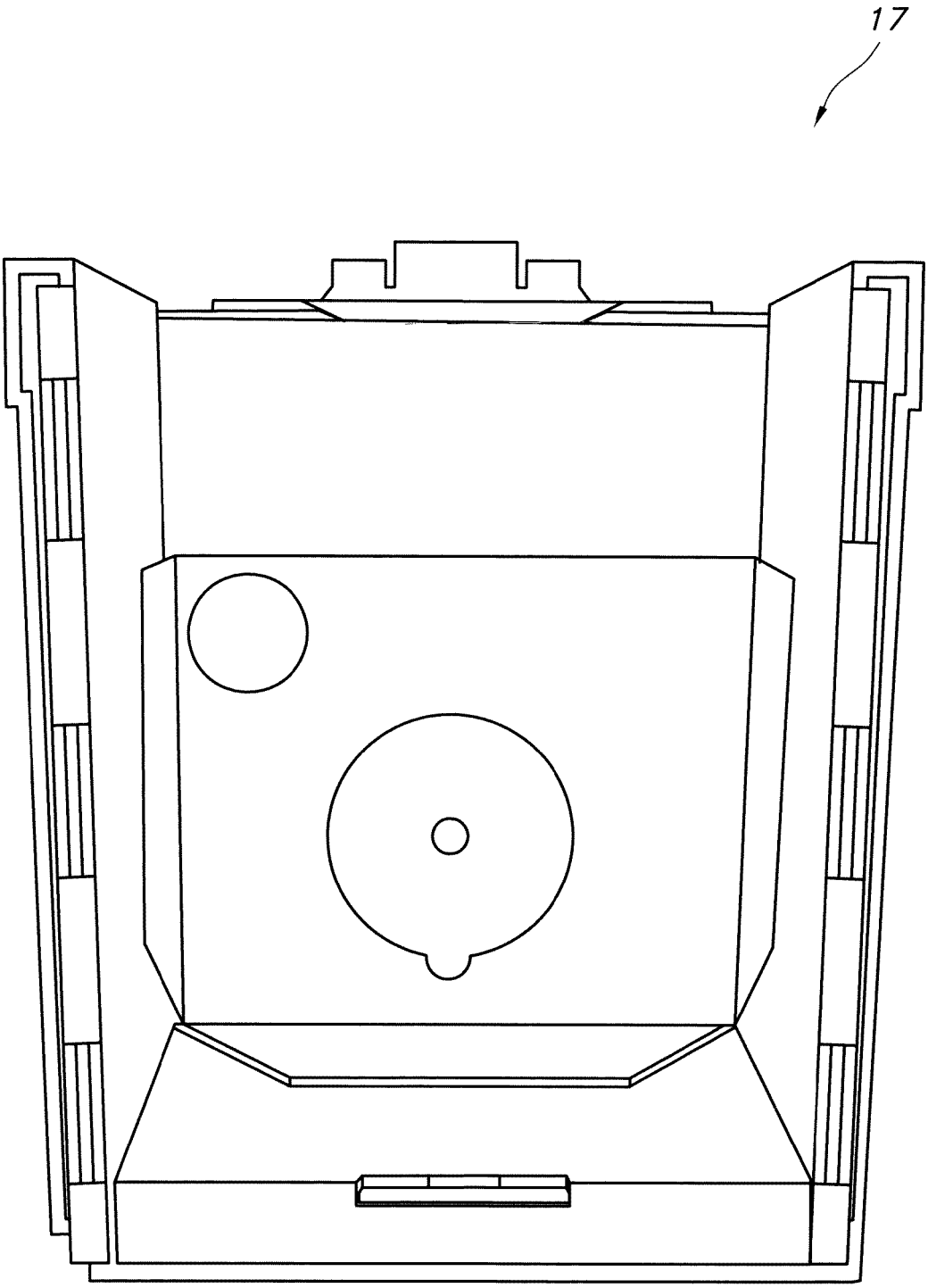

FIG. 6 schematically illustrates a filling station for the containers;

FIG. 7 further schematically illustrates the details of the filling station;

FIG. 7*a* is a flow chart describing the steps associated with filling the containers;

FIG. 8 is a partially cutaway, close-up view of a portion of the filling station;

FIG. 9 is another partially cutaway, close-up view of a portion of the filling station;

FIG. 10 illustrates a case for associating with the container;

FIGS. 11-18 illustrate a further embodiment of the container according to the disclosure and the various steps that may be performed in one possible use of the container; and FIGS. 19 and 20 are cutaway side and bottom views of another embodiment of a container.

DETAILED DESCRIPTION

Figure 1:
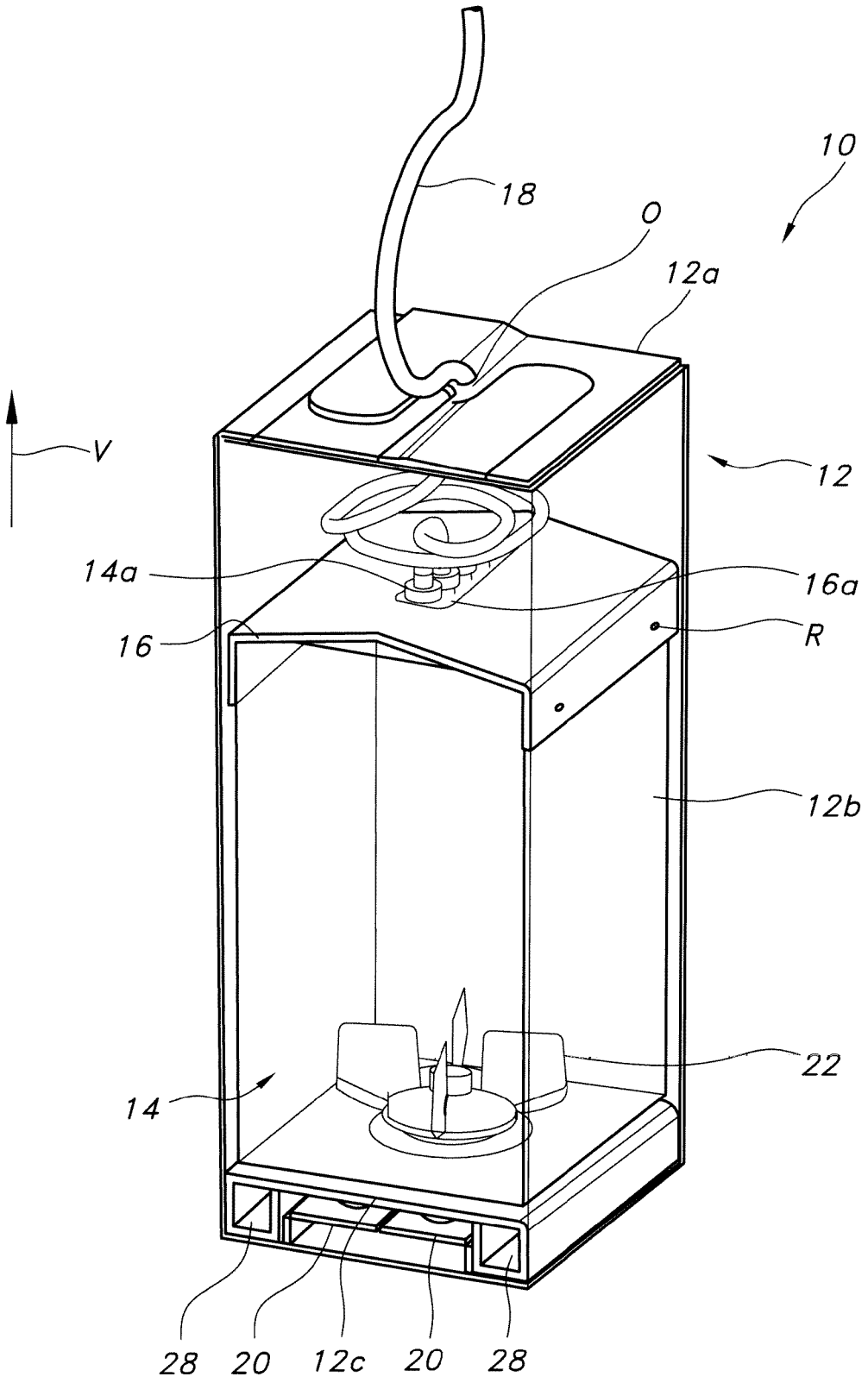
FIG. 1 is a perspective view of one embodiment of the container according to one aspect of the disclosure.

Reference is now made to FIG. 1, which illustrates one embodiment of a fluid handling apparatus in the form of a container 10 for receiving a fluid, such as for processing purposes. The container 10 includes an overpack 12 having an upper end including an upper wall 12*a*, one or more sidewalls 12*b* (four shown), and a base including a lower wall 12*c*. Together, these walls 12*a*, 12*b*, 12*c* define an interior adapted for receiving an at least partially flexible fluid vessel, such as a bag 14, which may be shaped so as to generally match the configuration of the interior (e.g., a cubic bag for a cubic interior). The overpack 12 in use thus serves to hold the vessel in place and also protects it from external interference, thus helping to avoid perforations and, if applicable, maintain an aseptic condition.

A divider or partition 16 is located in the interior of the overpack 12 to form a compartment for receiving the vessel or bag 14, and is generally oriented in a plane parallel to the upper and lower walls 12*a*, 12*c* and thus transverse to the sidewall 12*b*. In one aspect of the disclosure, the partition 16 is removable from the interior compartment of the overpack 12, yet capable of being retained in a particular position (such as adjacent to the upper portion of the bag 14) when the overpack is inverted. This retention may be accomplished by way of an attachment to the overpack 12, such as by using mechanical fasteners R (e.g., clips, screws, bolts, or the like) for connecting to the inner surface of the sidewall(s) 12*b*. Alternatively, fasteners in the form of adhesives (including tape), hook-and-loop fasteners, magnets, or the like could be used, alone or in combination with other fasteners. Still another alternative, as described in more detail below, is to provide vertically extending supports (such as spacers, blocks, legs, posts, dowels, etc., whether integral or otherwise) for supporting the partition 16 when the overpack 12 is inverted (which supports would engage the lower wall, which it should be appreciated is the upper wall 12*a* in the non-inverted condition).

Prior to being fixed in place, the partition 16 in the illustrated embodiment may be moved to a desired position along the interior of the overpack 12. This ability for relative movement advantageously allows the container 10 to be used in connection with a variety of shapes and sizes of bags, simply by making the necessary height adjustment. Further, this may allow for reuse of the overpack 12 with a replacement bag (possibly of a different size or shape), once a fluid processing operation is completed.

As shown in FIG. 1, the arrangement may be such that the bag 14 has a vertical dimension less than the corresponding dimension of the interior of the overpack 12. In such case, the partition 16 thus serves to create a space between the bag 14 and the opposing wall of the overpack 12, such as the upper wall 12*a* (which as discussed in more detail may comprise mating panels that allow for the insertion and removal of the bag into the interior of the overpack prior to or during the positioning of the partition). In the case where the bag 14 includes one or more ports 14*a* along the portion corresponding to the partition 16, this space may not only accommodate the ports, but may also receive a conduit 18, such as a length of tubing or hose used to deliver or recover fluid from the bag 14 at a location external to the overpack 12. Indeed, this space may be arranged for storing any excess conduit 18 when the container 10 is in use.

The partition 16 may be arranged to expose any ports 14*a* associated with the bag 14. This may be done by providing an opening 16*a* in the partition 16 sized and shaped to accommodate any port fitment. Specifically, the opening 16*a* may be arranged to allow the fitment base to register therein. This registration may provide an assurance as to the location of the ports 14*a*, which may be desirable for reasons that will be understood upon reviewing the following disclosure.

As mentioned previously, FIG. 1 also illustrates how the upper wall 12*a* of the overpack 12 may be formed by at least one, and possibly two, three, four, or more panels or flaps. The flap or flaps may be arranged to coincide (such as by overlapping with each other) and thereby create a temporary closure. The connection of the flaps may be with the sidewall(s) 12*b* by way of a hinge. An interlocking arrangement may be provided to ensure that the flaps remain in a closed condition when such is desired. As can be appreciated, this type of temporary locking arrangement may avoid the need for any tape or adhesive to maintain the closed condition of the upper wall 12 of the overpack 12, and thus facilitates reuse.

The flap or flaps, when present, should allow for the passage of the fluid, such as through the conduit 18, even when closed. This may be accomplished by providing an opening O for this purpose (which may be in any one flap, or between multiple flaps). Alternatively, this opening may be provided in the sidewall 12*b* or lower wall 12*c* of the overpack 12, if necessary or desired for a particular operation. Likewise, there could be one or more openings in more than one of these walls 12*a*, 12*b*, 12*c*, as necessary or desired.

Figure 2:
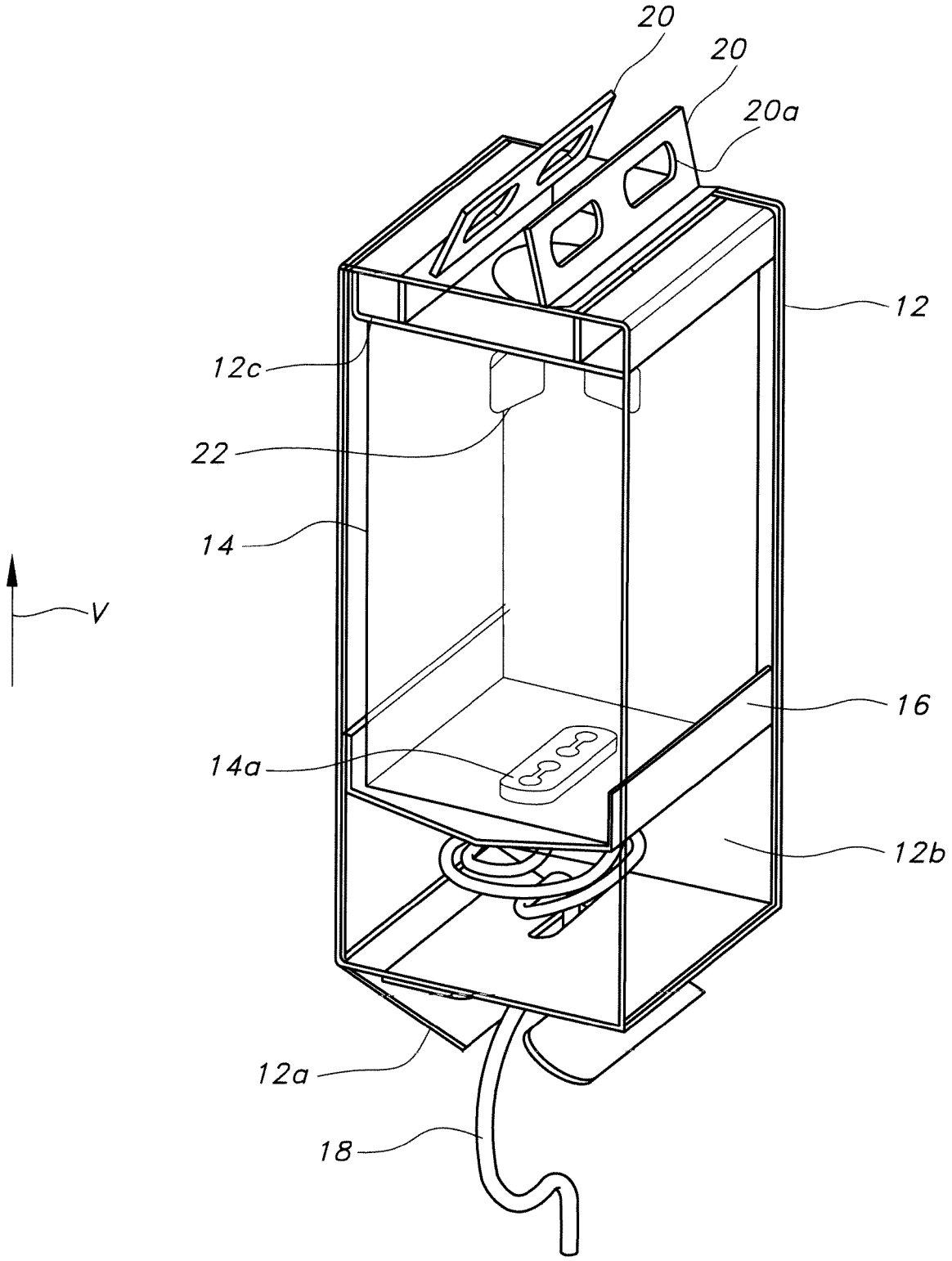
FIG. 2 is a further perspective view of the container of FIG. 1 in an inverted condition.

Another aspect of the disclosure relates to the ability to recover the fluid from the bag 14 by inverting it, as shown in FIG. 2. On inversion of the overpack 12, the partition 16 remains held in place due to the fixing (or otherwise) and thus supports the bag 14 in a similar spaced condition from the upper wall 12*a* of the overpack (which of course is now the lower wall by virtue of the inversion). Hence, subject to the opening of any valves on the conduit 18, any fluid in the bag 14 is free to flow out of it by way of gravity alone. As should be appreciated, this avoids the need to provide a separate drain in the floor of the bag 14, as the same structure, such as port 12*a*, may be used for both filling and dispensing, if desired. However, it is also possible to include a drain in the bag 14, which may be accessible through the overpack 12 (such as the side or bottom wall thereof; see FIGS. 19 and 20). Examples of suitable drain arrangements may be found in International Patent Application PCT/US2011/032808 and U.S. Patent Application Publication No. 20130037123, the disclosures of which are incorporated herein by reference.

To facilitate use in an inverted condition, the overpack 12 may be provided with one or more hangers. For example, as shown in FIG. 2, the overpack 12 may include hangers in the form of one or more openings adapted for receiving a support structure. More specifically, in the case where the base of the overpack 12 includes folding flaps 20, each may include at least one opening 20*a*, and possibly a pair of such openings. When the flaps 20 are unfolded and vertically oriented (note arrow V), as shown, the openings 20*a* in each flap 20 may align and register. Alternatively, the hanger or hangers may take the form of one or more strap loops connected to the container 10 (see, e.g., FIG. 18), or could be integrally formed in overpack 12 (such as a groove or channel), especially if formed of molded plastic (such as by injection or blow molding).

Figure 3:
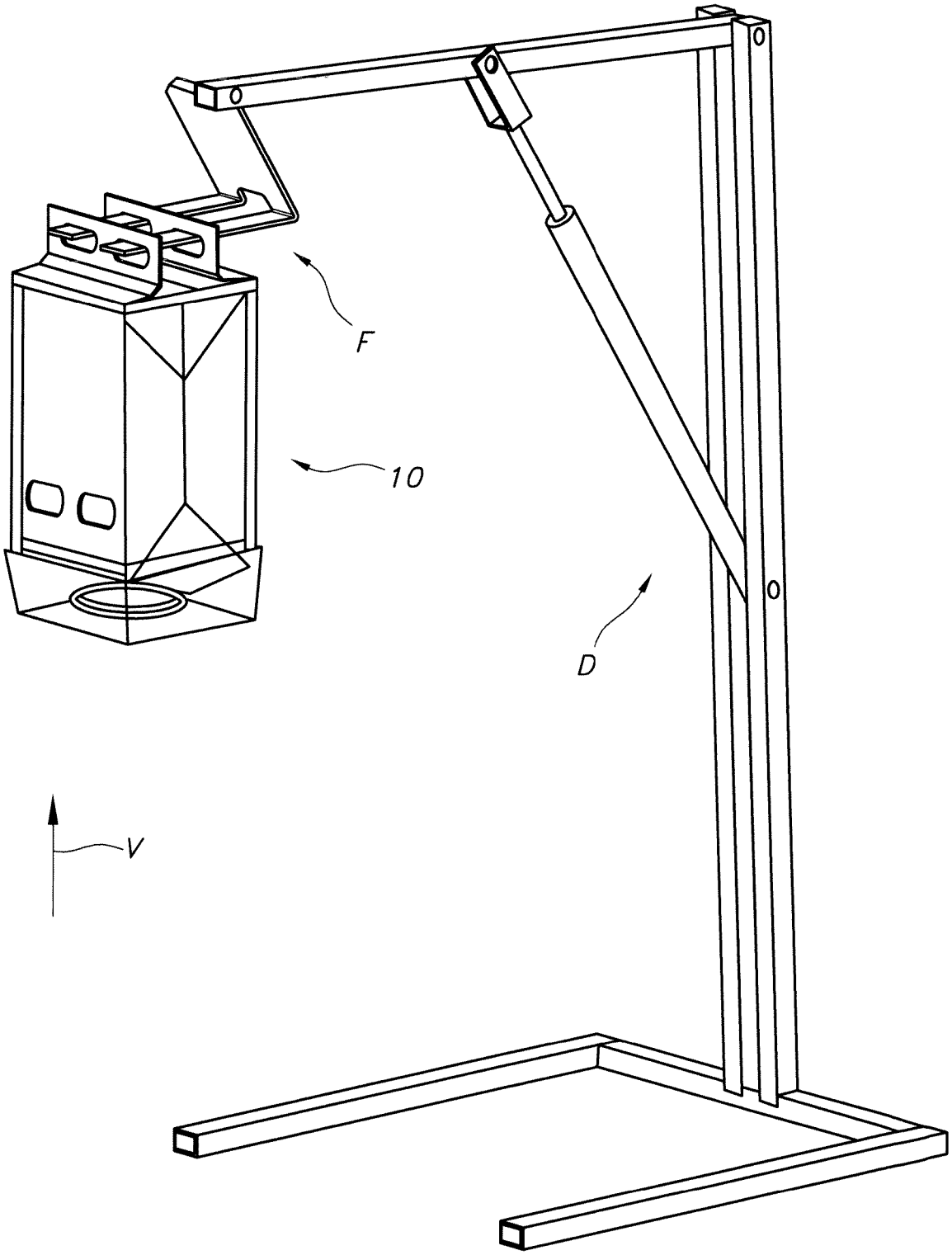
FIG. 3 is a perspective view showing the lifting of the inverted container of FIG. 2.

In this condition, the aligned openings 20*a* forming the hangers may readily receive a support structure for supporting the entire container 10 in the inverted condition. For instance, the structure for positioning in the openings 20*a* may comprise the bifurcated components, such as forks F, of a lifting device D. This lifting device D may be static, as shown in FIG. 3, or may be mobile for use in transporting the container 10 over the ground (such as to a particular location in a manufacturing facility for being dispensed).

In some instances, the bag 14 may include a component used during the fluid processing operation, such as for example a magnetic agitator 22 for agitating the fluid as the result of a non-contact coupling with an external motive device (which avoids the need to dynamic seals and shafts and thus helps to maintain the sterile condition of the interior compartment of the bag, when such is desired for a particular processing regimen). Such a magnetic agitator 22 may be retained against lateral movement by a post 22*a* (as described in detail in U.S. Pat. No. 7,481,572, the disclosure of which is incorporated herein by reference), but may be allowed to move along the post in the vertical direction (note arrow V) in order to accommodate the formation of a non-contact (e.g., magnetic) coupling with an external motive device (not shown).

To prevent such movement prior to use or after inversion, and thus reduce the risk of potential perforation should the walls of the bag come into contact with any part of the agitator 22 (such as the blades typically included), a retainer in the form of an external coupler 24 may be provided for forming a non-contact (again, possibly magnetic) coupling with the agitator 22. In one embodiment, this coupler 24 may be a thin, disc-shaped structure formed of a magnetic material, and may include a central opening for receiving any locator projection (not shown) for ensuring proper alignment.

Figure 4:
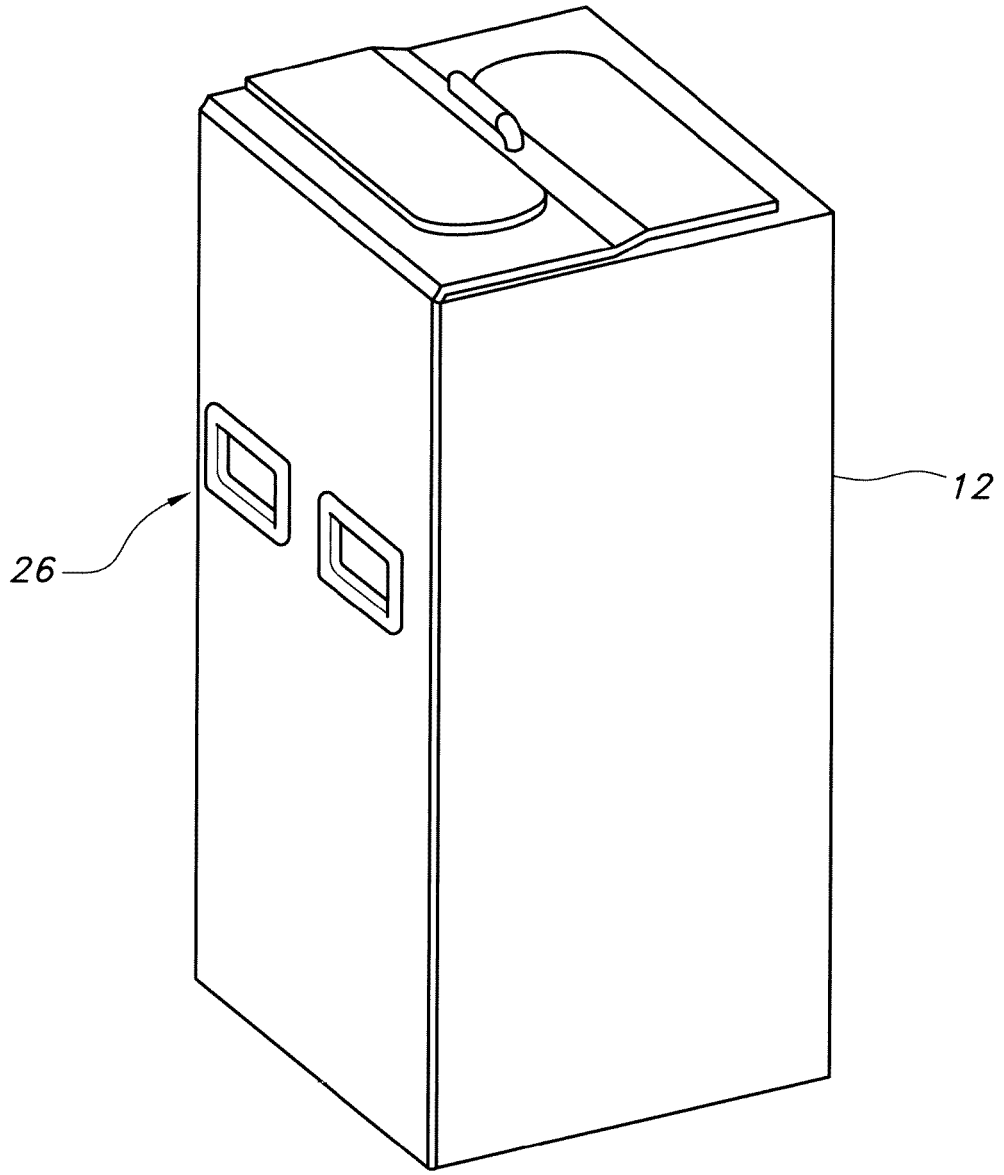
FIG. 4 is a perspective view of the container according to FIG. 1, illustrating the handles provided in a sidewall of the overpack.

As shown in FIGS. 2 and 4, this coupler 24 may be associated with the lower wall 12*c* of the base of the overpack 12, such as along a planar surface opposite the surface on which the bag 14 rests in the FIG. 1 arrangement. In the case of the movable panel or panels 20, the open condition may serve to expose a compartment in the base including this planar surface, and thus allow a user to access the coupler 24 or replace it, as the case may be. In either situation, the coupler 24 thus forms the coupling with the agitator (or any other component that may be used and can form a coupling with the coupler) to hold it at a known location within the bag 14. The holding function provided helps prevent undesirable contact between the agitator 22 and the bag material (which is typically a multi-layered polymer film).

It should also be appreciated that the inclusion of the mixer in the vessel (bag 14) allows for the single container 10 to be used for filling, processing, and then dispensing. Indeed, in cases where the fluid is not homogenized during filling, or when time has passed since filling such that the fluid has perhaps separated or settling has occurred, the mixer may advantageously be used for agitation and re-suspension prior to dispensing the fluid.

The container 10 may also be adapted to allow for easy manual lifting in either the inverted or non-inverted condition. Turning to FIG. 4, this may be achieved in one example by including one or more handles. For example, these handles may be provided in the form of openings 26 in the sidewall 12*b* of the overpack 12. The openings 26 may be sized and shaped for manual grasping by one or more users, and may be provided on multiple sides of the overpack 12 (such as on opposing sidewalls). These handles may of course facilitate removing the container 10 from the lifting device D once the draining operation is complete, and may also be useful for holding the overpack 12 in place while the bag 14 and partition 16 are manipulated during installation or removable.

Figure 5:
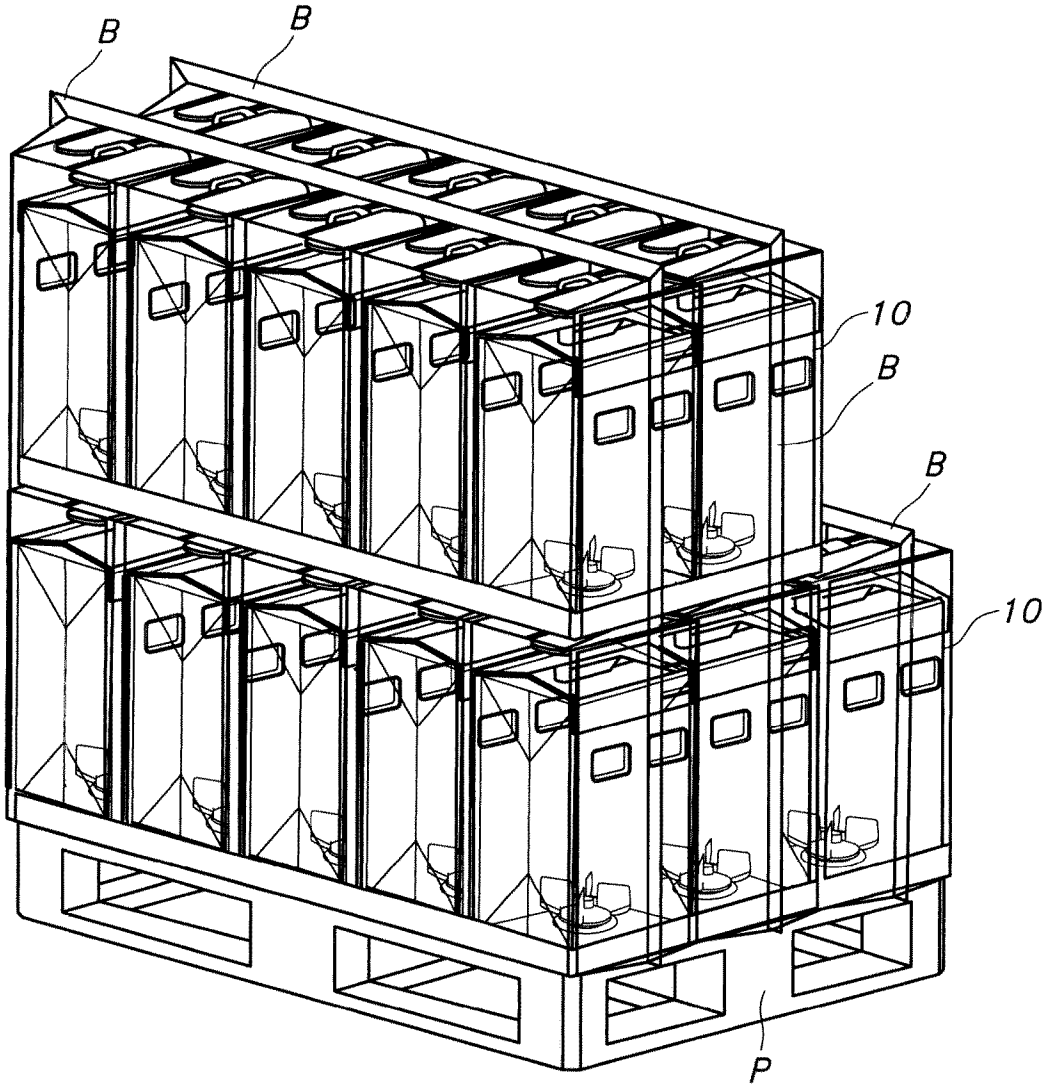
FIG. 5 is a perspective view showing a plurality of the containers grouped in bags and stacked on a pallet.

Turning back to FIG. 1, the overpack 12 may also be adapted for being lifted using a lifting device when in the normal orientation. This may be done by providing pockets or channels 28 adapted for receiving a bifurcated lifting device, such as forks F. As shown in FIG. 5, this allows for the container 10 to be lifted for purposes of being placed on a common pallet P or like structure.

With continued reference to FIG. 5, it can be appreciated that the container 10 is designed to be able to be stacked in an efficient manner. This may be achieved by providing the overpack 12 with generally planar polygonal walls, such as four rectangular sidewalls 12*b*, and generally square and upper and lower walls 12*a*, 12*c* with generally planar, matching surfaces. As can be appreciated, this allows for the stacking in a tightly controlled manner on the pallet, such as for transporting, either when empty or containing fluid. This remains the case even if the internal vessel is of a different size or shape among the containers 10 (that is, the matching size and shape of the overpack 12 allows for efficient stacking even when the bags 14 have different characteristics). However, it is within the broadest aspects of the disclosure to make the overpack 12 having a different shape, such as for example a cylindrical configuration (and perhaps with a matching bag 14 and partition 16 (such as, for example, one that is fruso-conical) to ensure a proper fit). Groups of the containers 10, such as two rows of five or one row of five, may also be contained in a protective bag B to guard against damage prior to use.

Turning to FIG. 6, the disclosed containers 10 are particularly well-suited for use in a system 100 that allows for simultaneous fluid filling of the associated internal flexible vessels, such as bags 14, in parallel. This system 100 may include a source of fluid, such as a tank 102. The tank 102 in turn may communicate with a delivery line 104 for simultaneously delivering the fluid to each container 10 connected to the line.

With further reference to FIGS. 7 and 8, this simultaneous delivery may be achieved using a pump (not shown) associated with the line 104 upstream of the bags 14. The bags 14, in turn, may each be associated with the delivery line 104 using a suitable connection, such as individual T-connectors 104*a* for connecting with a branch line 106. Instead of using a pump associated with the line 104, the fluid source, such as tank 102, could be pressurized to cause the fluid flow.

Each branch line 106 may connect with the free end of the conduit 18 of each container 10 for which filling is desired (possibly with a suitable relief valve to allow air to escape the vessel during filling), or may be connected directly to the port 14 of the flexible vessel, as shown. Each branch line 106 is also associated with a valve, such as a pinch valve 108 (e.g., ACRO Model 284 or Model 958), for controlling the fluid flow. Accordingly, by opening the valves and pumping the fluid through the delivery line 104, it flows through the branch lines 106 and ultimately to the containers 10. Once filled to the desired level, the delivery may be halted by closing the valve 108. The filled container 10 may be removed from the system 100 for later use, such as by being palletized as previously described and shown in FIG. 6.

In many instances, the filling of the vessels of each container 10 may not proceed at the same level due to various factors, such as flow rates, pressure, folds, and the like. Rather than having an operator visually monitor the filling operation or use level sensors, which may lead to inconsistent results in the event the bag 14 becomes folded in the overpack 12 prior to or during filling, the filling operation may be automated by associating each valve with a control system that controls the valve in order to regulate the fluid flow. As an example, each container 10 may be associated with a scale 110 for weighing the container 10 and fluid F. Using feedback, such as an output signal from a controller (see FIG. 7*a*) indicating that a particular weight has been reached, the valve 108 may close to halt fluid flow to the corresponding branch line 106. Since each container 10 when similarly constructed weighs essentially the same amount empty, the fluid filling may be achieved in a highly reliable manner that ensures that substantially the same amount of fluid is present in each vessel, such as bag 14. This feedback control system also allows for filling to proceed in a highly efficient manner, since the closing of the valve 108 in a sequential fashion would thus increase the fluid flow to the yet-to-be-filled containers 10, thereby expediting completion of the filling. The chance for operator uncertainty as to fill levels (especially when the box is opaque) is completely eliminated.

Once filling is complete, the bag 14 or vessel of each container 14 may be sealed. This may be done using an aseptic tube sealing system for sealing the conduit 18, such as a QUICKSEAL device. Alternatively, a fitting may be provided on the conduit 18, including possibly one incorporating a sterile filter.

Still referencing FIGS. 7 and 8, it can be appreciated that the system 100 may include a subsystem for handling excess gas, such as air, purged from the containers 10 prior to or during the filling operation. This handling of fluid may be achieved in one possible embodiment by providing a reservoir in the form of a bag 112 for receiving the gas during a purging operation.

An upstream pump, such as a peristaltic pump 114, may be used to control the flow to this bag 112, such as by opening to allow gas to pass and then closing before fluid is introduced to the delivery line 104. An associated valve 116 (e.g., a PENDOTECH throttling pinch valve) may be used to close delivery line 104 and thus prevent any flow from returning to the source, such as tank 102.

Likewise, once filling is complete, fluid remaining in the line 104 must be purged. A second reservoir, such as a bag 118, may be provided adjacent to the end of the line 104, and may also be associated with a valve, such as a pinch valve 120. This valve 120 is normally closed during the initial purge and filling operation, but then opened when the valves 108 and 116 are closed. The peristaltic pump 114 may then be used to force the remaining fluid to flow into the bag 118 serving as the second reservoir.

With reference again to FIGS. 7 and 8, it can be understood that a distributor 122 may be provided for associating with multiple delivery lines for supplying fluid to other containers, such as for sampling, testing, or other possible uses. For example, as shown in FIG. 7, a second delivery line 105 may be connected to a second output of the distributor 122 for supplying fluid to one or more containers, such as two dimensional "pillow" style bags having a relatively small volume compared to the containers 10. As shown in FIG. 10, these bags 124 may be associated with a single rigid holder, which may be a "clam shell"-type of case 126 having a base 126*a* and a movable lid 126*b* to allow the desired fluid connections to be made (such as by way of an individual conduit 128). The operation may be essentially as described above with respect to the containers 10 of the delivery line 104.

Figure 13:
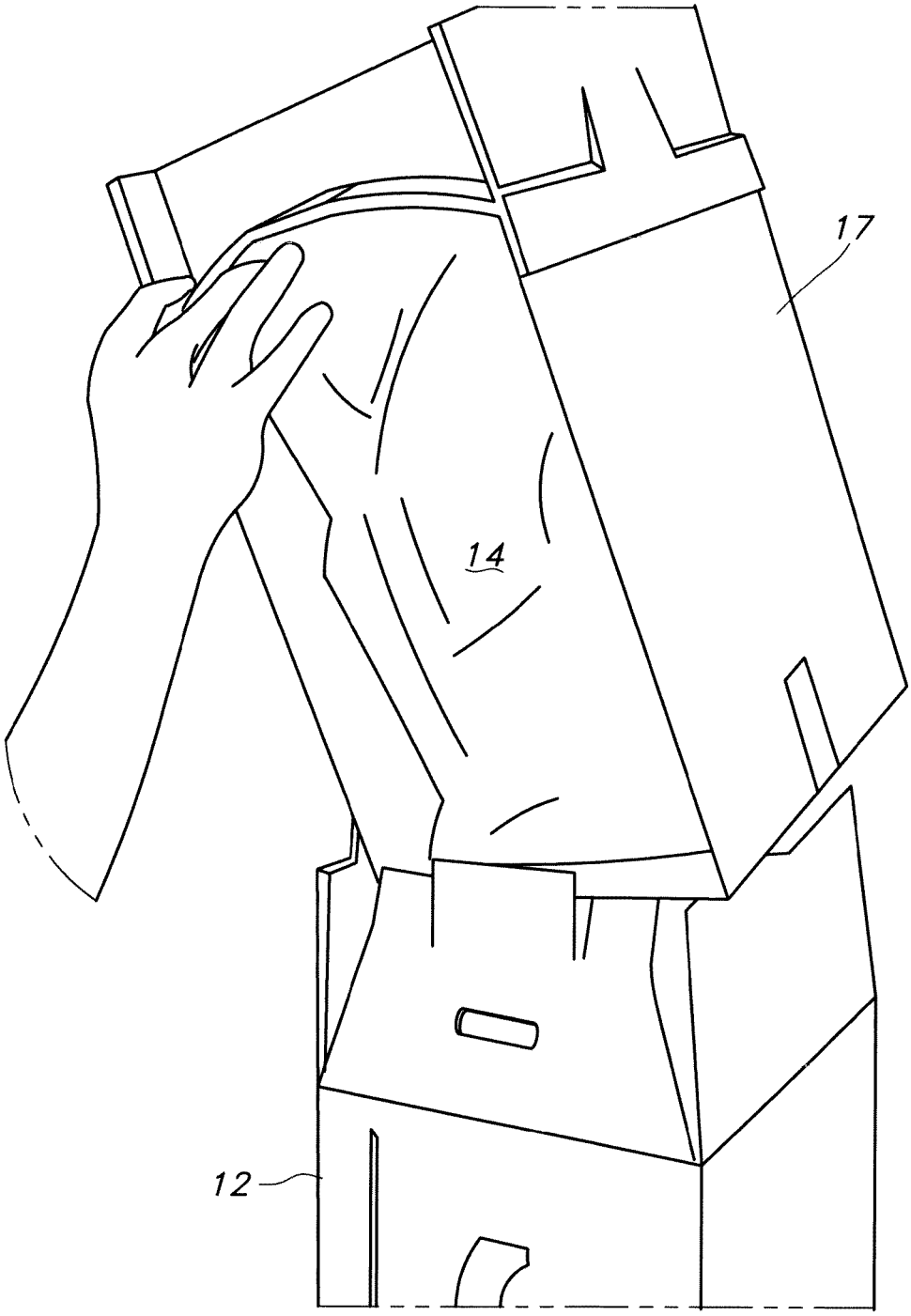
Figure 14:
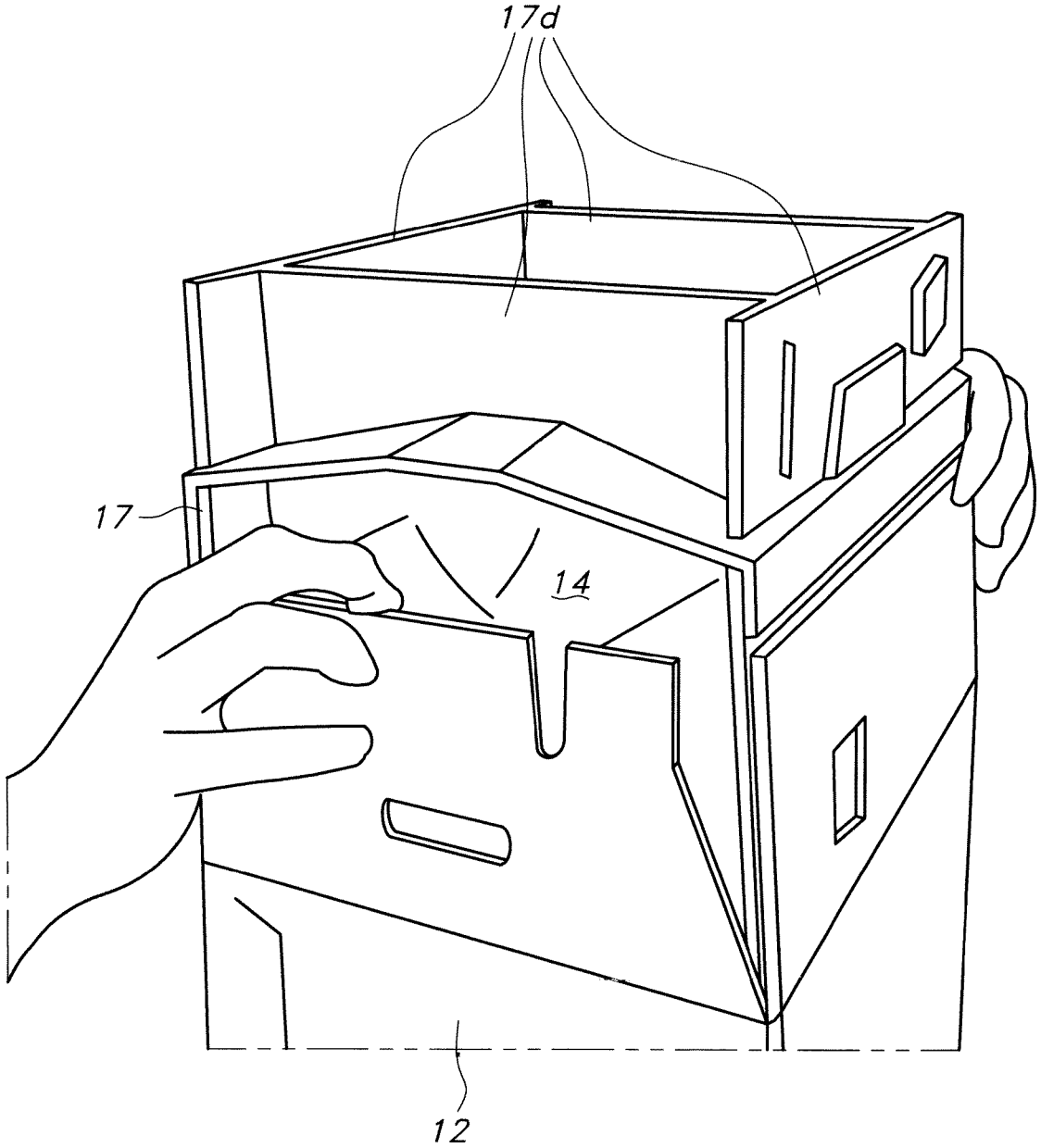

A second embodiment of the container 10 is also disclosed, with reference to FIGS. 11-18. This embodiment includes features in common to the first one shown in FIGS. 1 and 2, such as a flexible vessel or bag 14 for positioning in an overpack 12. In this embodiment, the partition 16 forms part of a carrier 17 designed to nest in the interior of the overpack 12. As can be see perhaps best in FIG. 12, this carrier 17 includes a lower wall 17*a* and sidewalls 17*b* that together with the partition 16 form at least one open side for receiving the flexible vessel. Thus, as shown in FIGS. 13-14, the vessel, such as bag 14, may be positioned within the carrier 17 and then the two structures together inserted into the overpack 12, which may then be closed by folding flaps forming the upper wall thereof.

FIG. 14 perhaps best shows that the carrier may be provided with extensions 17*d* that project in the vertical direction to end at a position close to the lower surface of the upper wall 12*a* of the overpack. When the container 10 is inverted, these projections 17*d* thus serve to engage the opposing wall of the overpack 12 (i.e., the upper wall 12*a*, which is actually below the lower wall 12*c* in the inverted condition) and thereby reliably support the weight of the bag 14 and fluid, including prior to and during any draining operation. This arrangement may of course avoid the need for attaching the partition 16 to any part of the overpack 12, but it may also inhibit flexibility since a more limited range of bag sizes may be accommodated in the carrier 17 (as contrasted with the case in which the partition 16 is freely height adjustable within the interior of the overpack 12). Similar extensions may also be provided adjacent to the bottom of the carrier 17 in order to create a space for receiving a drain, a fitment on the bag, or tubing. An opening may also be provided in the lower portion of the carrier 17 and/or the overpack 12 for allowing such components to project from the compartment including the bag 14.

As mentioned above, it should be appreciated that the extensions 17*d* (whether in the form shown or otherwise, such as for example Styrofoam blocks adhered in place) may be used in connection with other embodiments, such as the embodiment of FIG. 1, to lend support to the vessel, such as bag 14, in the inverted condition. Also, the extensions need not be attached to the partition 16 itself, but instead could be attached to one or more walls of the overpack 12.

Figure 15:
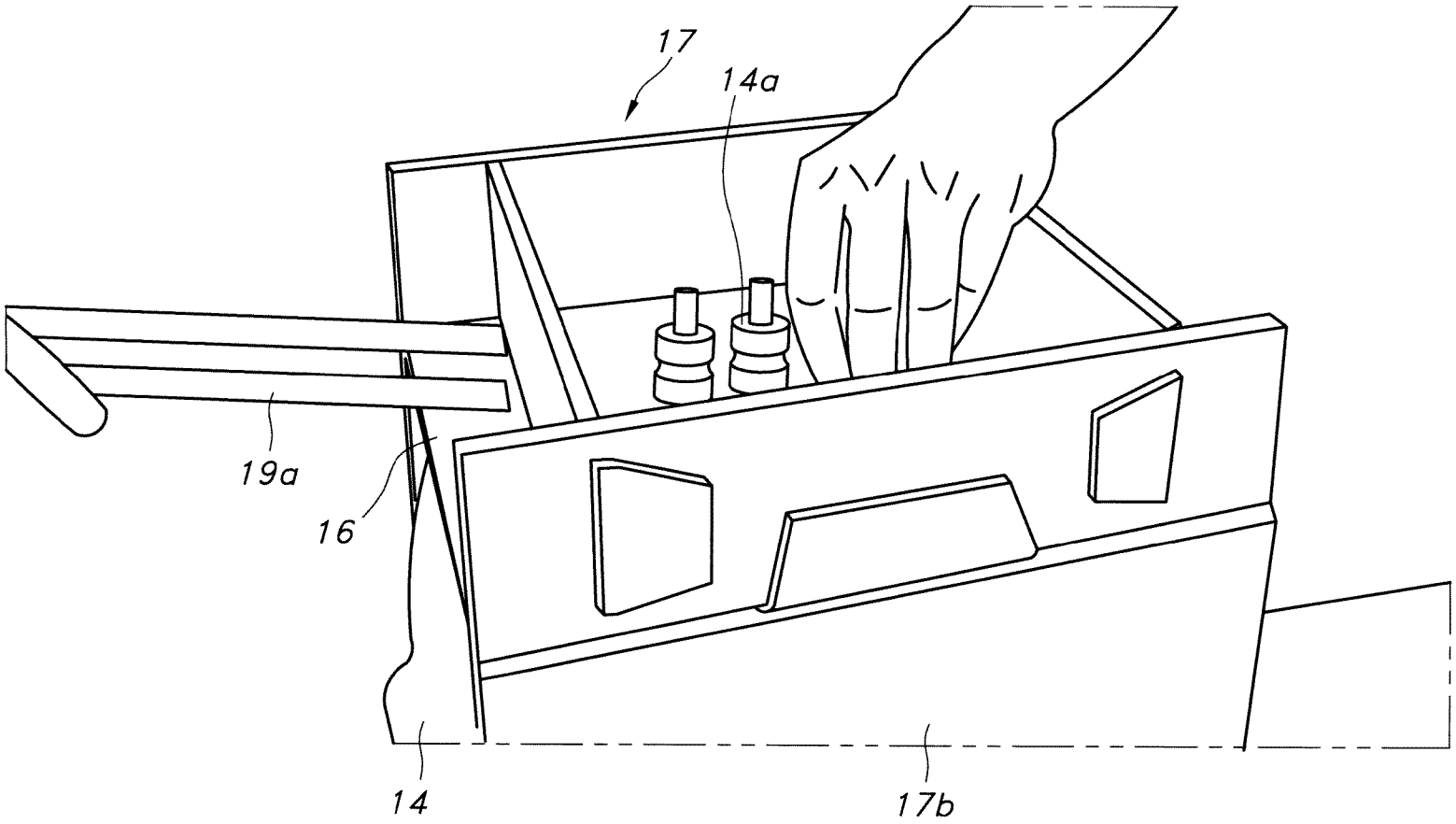
Figure 16:
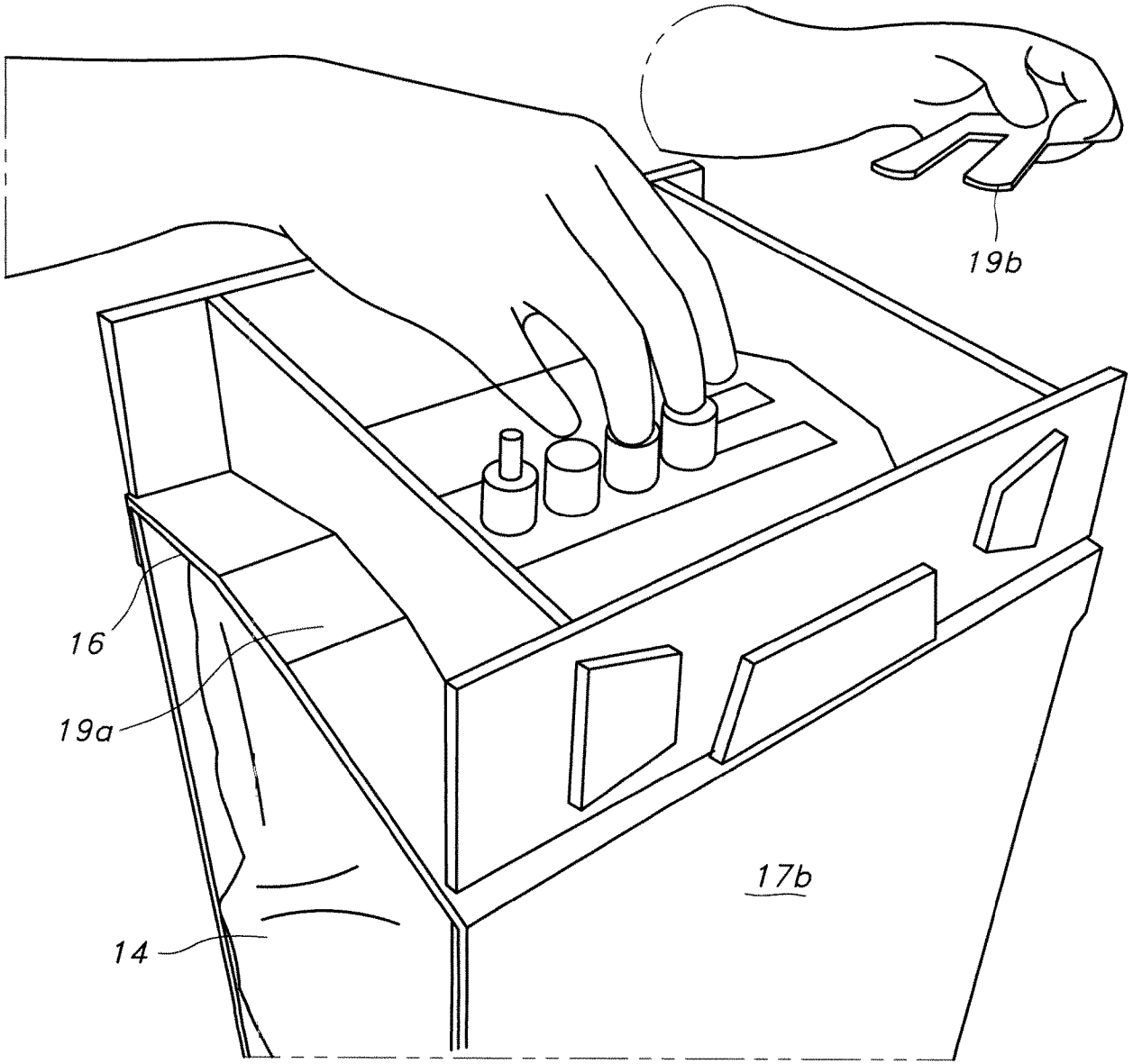

An optional step of assembly may be to retain the port 14*a* of the vessel or bag 14 relative to the carrier 17. As shown in FIGS. 15 and 16, this may be done by passing any fitment associated with port 14*a* through a corresponding opening in the partition 16, as described above. At least one, and possibly a pair of port retainers, such as in the form of forks 19*a*, 19*b*, may be passed through slots formed in one or more of the supports 17*d* of carrier 17 and engage the port fitment, such as along a peripheral flange.

Turning now to FIG. 17, it can also be seen that the coupler 24 may be associated with the carrier 17 prior to insertion in the overpack 12. FIG. 18 illustrates the carrier of FIG. 17 inserted into the overpack 12, with flaps 20 opened to expose the access compartment for the coupler 24. Also noteworthy is the provision of strap loops 21, which may be used to facilitate withdrawing the carrier 17 from the overpack 12, both before installation of the bag 14 therein and in order to perform a replacement operation.

As mentioned above, the bag 14 is typically formed of one or more layers of thin polymer film, such as polypropylene or polyethelyene. As contrasted with this flexible film, the overpack 12 may be constructed of considerably more rigid materials, such as cardboard, paperboard, plastic, and combinations thereof (with a preference for lightweight materials that can withstand multiple uses and ultimately be recycled). The materials of the overpack 12 may also be reinforced or corrugated for added strength and crush resistance. However, it is also possible to form the overpack 12 of metal in order to provide a more robust container 10, but with corresponding limitations in terms of cost and weight.

FIGS. 19 and 20 illustrate an embodiment in which the carrier 17 is provided with compartments for receiving external structures, such as fittings, drains, tubes, etc. For instance, an external compartment may be provided in the carrier 17 for receiving a downwardly projecting drain, which may pass through an opening in the bottom wall of the carrier 17 (note the opening in FIG. 20 adjacent to the opening for receiving a projecting from the vessel). FIG. 19 also illustrates an opening provided in a sidewall of the carrier for containing the vessel, such as bag, and allowing for a side port fitment or drain to pass. A side compartment may also be provided in the carrier 17 to accommodate any laterally-extending components.

As also shown in FIG. 19, extensions, such as strap loops 23, associated with the bag 14 (including any carrier 17) may also extend through the overpack 12, such as through openings 26. These extensions or straps may be used to allow for the lifting force to be transmitted directly to the carrier 17, which helps to prevent the overpack 12 from failing as a result of the weight of the fluid when the assembly is lifted.

Turning back to FIGS. 8 and 9, it may also be understood that the the upper end of the overpack 12 may comprise a lid D for associating with the sidewalls 12*b*. The lid D may include the partition 16, or it may be a separate structure. Flaps associated with the lid D may connect with the sidewall 12*c* to complete the container 10 and ensure a stable and secure arrangement is formed.

The foregoing descriptions of several embodiments made according to the disclosure of certain inventive principles herein are presented for purposes of illustration and description. The embodiments described are not intended to be exhaustive or to limit the invention to the precise form disclosed and, in fact, any combination of the components of the disclosed embodiments is contemplated. The term "flexible" as used herein in the context of the vessel refers to a structure of the vessel that, in the absence of auxiliary support, may conform to the shape of the fluid contained in the vessel, as contrasted with a "rigid" structure, which retains a pre-determined shape when the fluid is present in the vessel. Modifications or variations are possible in light of the above teachings. For instance, measuring of the fluid into the vessels may be achieved using flow meters or a diaphragm pump associated with the branch lines. The wall of the carrier 17 serving as the partition 16 may also be made adjustable such that the carrier may be adapted to accommodate different sizes of bags. The embodiments described were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention when interpreted in accordance with the breadth to which it is fairly, legally, and equitably entitled.

The invention claimed is:

1. An apparatus for receiving an at least partially flexible vessel adapted for receiving a fluid, comprising:

an overpack including a base having a floor and an upstanding sidewall forming an interior for receiving the vessel; and a partition removably positioned in the interior of the overpack, the partition extending generally transverse to the sidewall and generally aligned with the floor to form a compartment in the interior of the overpack for receiving the vessel;

wherein the base of the overpack includes a door for providing access to an exterior compartment of the base.

2. The apparatus of claim 1, wherein the overpack includes at least one hanger for hanging the overpack.

3. The apparatus of claim 2, wherein the base includes the at least one hanger.

4. The apparatus of claim 1, wherein the overpack includes an upper wall adapted for receiving a conduit for connecting with the vessel in the overpack.

5. The apparatus of claim 4, wherein the partition is adapted for receiving the conduit.

6. The apparatus of claim 1, wherein the partition includes an apex formed by a pair of sloped walls adapted for causing fluid to drain from the vessel.

7. The apparatus of claim 1, further including a coupler adapted for forming a non-contact coupling with a component in the vessel.

8. The apparatus of claim 7, wherein the component comprises a magnetic agitator, and the coupler comprises a material for forming a magnetic coupling with the magnetic agitator.

9. The apparatus of claim 1, further including a retainer for removably retaining the partition within the interior compartment of the overpack.

10. The apparatus of claim 1, wherein the overpack further includes at least one receiver adapted for receiving a lifting device.

11. The apparatus of claim 1, wherein the overpack comprises a handle, the handle comprising at least one opening formed in at least one sidewall of the overpack, the opening adapted for being grasped by a hand of a user.

12. The apparatus of claim 1, further including a tubing positioned in a space between an upper surface of the partition and a lower surface of an upper wall of the overpack.

13. The apparatus of claim 1, further including a carrier adapted for receiving the vessel and for nesting in the interior of the overpack.

14. The apparatus of claim 1, further including a support for supporting the partition in at least an inverted condition of the overpack.

15. An apparatus, comprising:

an at least partially flexible vessel adapted for receiving a fluid, the vessel including an agitator;

an overpack including a base having a floor and an upstanding sidewall forming an interior for receiving the vessel; and a partition removably positioned in the interior of the overpack, the partition extending generally transverse to the sidewall and generally aligned with the floor to form a compartment in the interior of the overpack for receiving the vessel.

16. The apparatus of claim 15, wherein the base of the overpack includes a door for providing access to an exterior compartment of the base separate from the interior of the vessel.

17. An apparatus, comprising:

at least partially flexible vessel adapted for receiving a fluid, the vessel including an upper portion having a conduit for communicating fluid to or from an interior compartment of the at least partially flexible vessel, and a lower portion;

an overpack including a base having a floor for supporting the lower portion of the at least partially flexible vessel and an upstanding sidewall forming an interior; and a partition removably positioned in the interior of the overpack, the partition extending generally transverse to the sidewall and generally aligned with the floor, the partition forming a first compartment in the interior of the overpack for receiving the at least partially flexible vessel and a second compartment for receiving the conduit connected to the upper portion of the at least partially flexible vessel; and a hanger associated with the base of the overpack for hanging the vessel in an inverted condition for draining the fluid from the interior compartment of the at least partially flexible vessel through the conduit.

18. The apparatus of claim 17, wherein the base of the overpack includes a door for providing access to an exterior compartment of the base below the floor.

19. The apparatus of claim 17, wherein the hanger comprises a pair of hangers, each of the pair of hangers including an opening for aligning for receiving a support for supporting the overpack in an inverted condition.

20. The apparatus of claim 19, wherein each hanger comprises a flap connected to the overpack.

* * * * *